US011373583B2

(12) United States Patent
Yang et al.

(10) Patent No.: US 11,373,583 B2
(45) Date of Patent: Jun. 28, 2022

(54) DRIVE CIRCUIT, DRIVING METHOD THEREOF AND DISPLAY DEVICE

(71) Applicant: BOE Technology Group Co., Ltd., Beijing (CN)

(72) Inventors: Ming Yang, Beijing (CN); Ning Cong, Beijing (CN); Minghua Xuan, Beijing (CN); Can Zhang, Beijing (CN); Xiaochuan Chen, Beijing (CN); Can Wang, Beijing (CN); Han Yue, Beijing (CN); Jiao Zhao, Beijing (CN); Angran Zhang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 211 days.

(21) Appl. No.: 16/955,171

(22) PCT Filed: Jul. 18, 2019

(86) PCT No.: PCT/CN2019/096615
§ 371 (c)(1),
(2) Date: Jun. 18, 2020

(87) PCT Pub. No.: WO2021/007866
PCT Pub. Date: Jan. 21, 2021

(65) Prior Publication Data
US 2022/0139297 A1 May 5, 2022

(51) Int. Cl.
*G09G 3/32* (2016.01)

(52) U.S. Cl.
CPC ..... *G09G 3/32* (2013.01); *G09G 2310/08* (2013.01); *G09G 2320/0214* (2013.01)

(58) Field of Classification Search
CPC ..... G09G 3/32; G09G 2310/08; G09G 2320/0214
See application file for complete search history.

(56) References Cited

U.S. PATENT DOCUMENTS 5,287,070 A 2/1994 Thelen et al.
9,905,166 B2 * 2/2018 Qing ..... G09G 3/3258
(Continued)

FOREIGN PATENT DOCUMENTS

CN 104103233 A 10/2014
CN 104753505 A 7/2015
(Continued)

*Primary Examiner* — Andrew Sasinowski
(74) *Attorney, Agent, or Firm* — ArentFox Schiff LLP; Michael Fainberg

(57) ABSTRACT

Embodiments of the present disclosure disclose a drive circuit, a driving method thereof and a display device. The drive circuit includes: a current control circuit, configured to provide a drive signal to a device to be driven according to a signal of a data signal terminal; a first transistor, electrically connected between the current control circuit and the device to be driven; and a duration control circuit, electrically connected with a gate of the first transistor, and configured to provide a light-emitting duration modulating signal to the gate of the first transistor according to a combined action of signals of a scanning signal terminal, a light-emitting control signal terminal, a duration control signal terminal and a reference voltage signal terminal, to control a conduction duration of the first transistor.

20 Claims, 13 Drawing Sheets

(56) References Cited

U.S. PATENT DOCUMENTS

| | | | | |
|---|---|---|---|---|
| 10,373,555 | B2 * | 8/2019 | Li | G09G 3/3233 |
| 2015/0187335 | A1 | 7/2015 | Sugiyama et al. | |
| 2015/0339979 | A1 | 11/2015 | Kikuchi et al. | |
| 2019/0130833 | A1 * | 5/2019 | Gao | G09G 3/3291 |
| 2020/0026378 | A1 * | 1/2020 | Wang | G09G 3/3692 |
| 2020/0105185 | A1 * | 4/2020 | Chen | F21S 4/20 |
| 2020/0135287 | A1 * | 4/2020 | Han | G09G 3/3677 |
| 2020/0184894 | A1 * | 6/2020 | Shi | G09G 3/32 |
| 2020/0286432 | A1 * | 9/2020 | Zhang | G09G 3/3208 |

FOREIGN PATENT DOCUMENTS

| | | | |
|---|---|---|---|
| CN | 109448625 | A | 3/2019 |
| CN | 109872686 | A | 6/2019 |
| WO | 9325045 | A1 | 12/1993 |

* cited by examiner

DRIVE CIRCUIT, DRIVING METHOD THEREOF AND DISPLAY DEVICE

CROSS REFERENCE TO RELATED APPLICATIONS

This application is a National Stage of International Application No. PCT/CN2019/096615, filed on Jul. 18, 2019, which is hereby incorporated by reference in its entirety.

FIELD

The present disclosure relates to the field of display technologies, in particular to a drive circuit, a driving method thereof and a display device.

BACKGROUND

Organic light emitting diodes (OLEDs), quantum dot light emitting diodes (QLEDs), micro light emitting diodes (micro LEDs) and other electroluminescent diodes have such advantages as self-illumination and low energy consumption, and become one of the hot spots in the application research field of the electroluminescent display device nowadays. A drive circuit is adopted in general electroluminescent display devices to drive the electroluminescent diode to emit light. However, due to limitations of a manufacturing procedure, the brightness adjustment range of the electroluminescent diode is limited.

SUMMARY

A drive circuit provided in an embodiment of the present disclosure includes:

a current control circuit, configured to provide a drive signal to a device to be driven according to a signal of a data signal terminal;

a first transistor, electrically connected between the current control circuit and the device to be driven; and a duration control circuit, electrically connected with a gate of the first transistor, and configured to provide a light-emitting duration modulating signal to the gate of the first transistor according to a combined action of a signal of a scanning signal terminal, a signal of a light-emitting control signal terminal, a signal of a duration control signal terminal and a signal of a reference voltage signal terminal, to control a conduction duration of the first transistor.

Optionally, in the embodiment of the present disclosure, the duration control circuit includes an input control sub-circuit and a comparison sub-circuit;

the input control sub-circuit is configured to provide the signal of the duration control signal terminal to a connection node in response to the signal of the scanning signal terminal, and provide a signal of the connection node to the comparison sub-circuit in response to the signal of the light-emitting control signal terminal; and the comparison sub-circuit is configured to output the light-emitting duration modulating signal according to a signal output by the input control sub-circuit and the signal of the reference voltage signal terminal.

Optionally, in the embodiment of the present disclosure, the input control sub-circuit includes: a second transistor, a third transistor and a first capacitor;

a gate of the second transistor is electrically connected with the scanning signal terminal, a first end of the second transistor is electrically connected with the duration control signal terminal, and a second end of the second transistor is electrically connected with the connection node;

a gate of the third transistor is electrically connected with the light-emitting control signal terminal, a first end of the third transistor is electrically connected with the connection node, and a second end of the third transistor is electrically connected with the comparison sub-circuit; and the first capacitor is electrically connected between a first power terminal and the connection node.

Optionally, in the embodiment of the present disclosure, the comparison sub-circuit includes a comparator; an in-phase input of the comparator is electrically connected with the input control sub-circuit, an anti-phase input of the comparator is electrically connected with the reference voltage signal terminal, and an output of the comparator is electrically connected with the gate of the first transistor.

Optionally, in the embodiment of the present disclosure, the current control circuit includes a drive transistor, a fourth transistor and a second capacitor;

a gate of the fourth transistor is electrically connected with the scanning signal terminal, a first end of the fourth transistor is electrically connected with the data signal terminal, and a second end of the fourth transistor is electrically connected with a gate of the drive transistor;

a first end of the drive transistor is electrically connected with the first power terminal, and a second end of the drive transistor is electrically connected with the first end of the first transistor; and the second capacitor is electrically connected between the gate of the drive transistor and the first power terminal.

Optionally, in an embodiment of the present disclosure, the drive circuit further includes: a fifth transistor, wherein the first transistor is electrically connected with the device to be driven through the fifth transistor; and the gate of the fifth transistor is electrically connected with the light-emitting control signal terminal.

An embodiment of the present disclosure further provides a display device, including:

a substrate;

a plurality of sub-pixels, on one side of the substrate; and at least one of the plurality of sub-pixels includes a light-emitting device and the above drive circuit, wherein the light-emitting device serves as the device to be driven.

Optionally, in the embodiment of the present disclosure, the display device further includes: a plurality of light-emitting control signal lines and a light-emitting control input; wherein light-emitting control signal terminals of the drive circuits of a row of sub-pixels are correspondingly electrically connected with a light-emitting control signal line; and each of the light-emitting control signal lines is electrically connected with the light-emitting control input.

Optionally, in the embodiment of the present disclosure, the display device further includes: a plurality of light-emitting control signal lines independent with one another; and light-emitting control signal terminals of the drive circuits of a row of sub-pixels are correspondingly electrically connected with a light-emitting control signal line.

Optionally, in the embodiment of the present disclosure, the device to be driven includes: at least one of a micro light emitting diode, an organic electroluminescent diode or a quantum dot light emitting diode.

An embodiment of the present disclosure further provides a driving method of the above display device, includes:

for each row of sub-pixels, inputting, by the current control circuit, the signal of the data signal terminal in response to the signal of the scanning signal terminal in a signal input stage;

inputting, by the duration control circuit, the signal of the duration control signal terminal in response to the signal of the scanning signal terminal in the signal input stage;

generating, by the current control circuit, the drive signal which drives the device to be driven to emit light according to the signal of the data signal terminal; and providing, by the duration control circuit, the light-emitting duration modulating signal to the gate of the first transistor according to the combined action of the signal of the light-emitting control signal terminal, the signal of the reference voltage signal terminal and the signal of the duration control signal terminal, to control the conduction duration of the first transistor; wherein a voltage of the reference voltage signal terminal is changed monotonously in a preset duration, a voltage of the duration control signal terminal is a fixed voltage and the fixed voltage is within the monotonously changed range of the voltage of the reference voltage signal terminal, and one frame includes the signal input stage and the light-emitting stage.

DETAILED DESCRIPTION OF THE EMBODIMENTS

Figure 1:
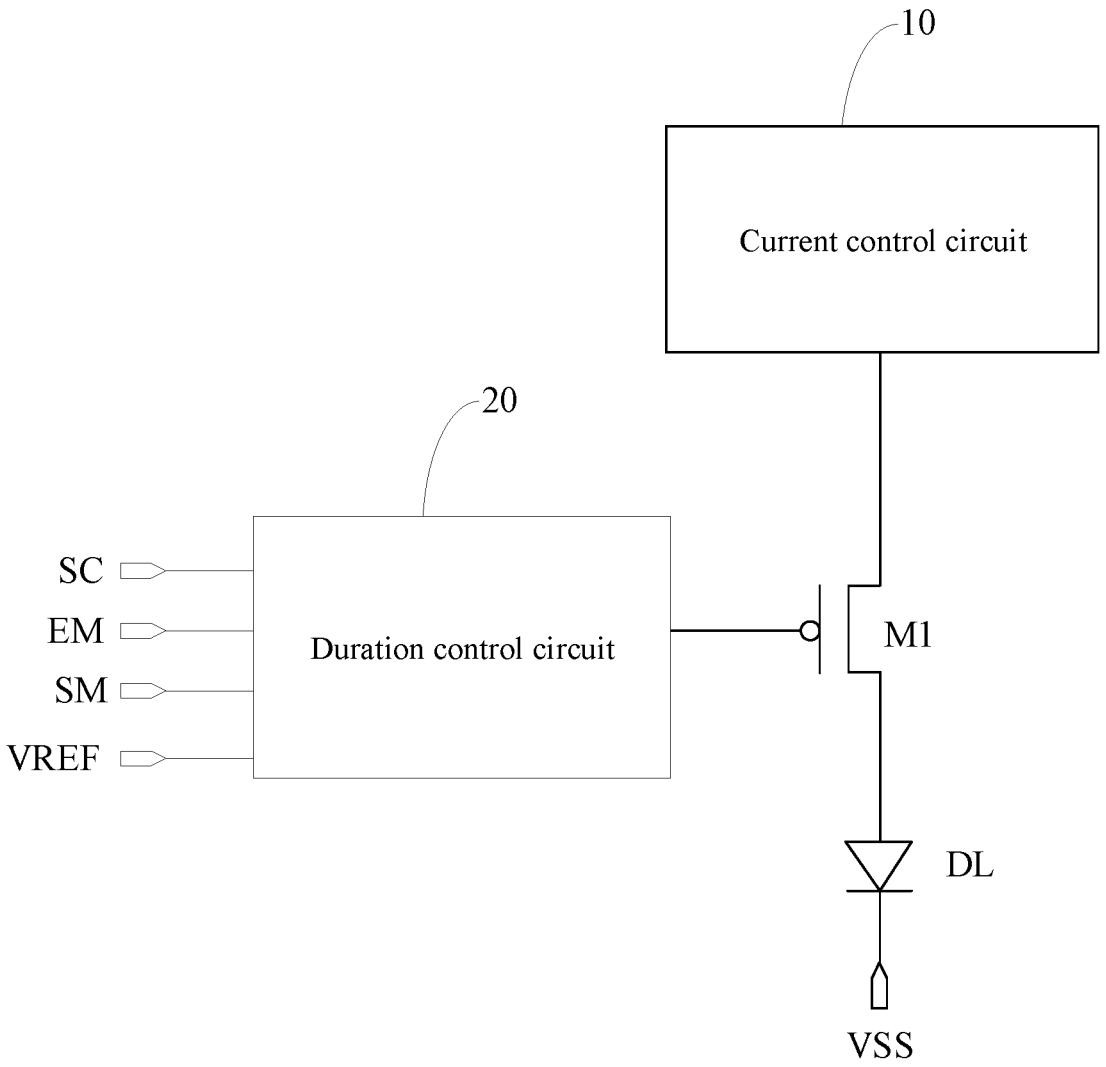
FIG. 1 is a structural schematic diagram of a drive circuit provided in an embodiment of the present disclosure.

In order to make the objectives, technical solutions, and advantages of the embodiments of the present disclosure clearer, a clear and complete description of the technical solutions of the embodiments of the present disclosure will be given below in combination with accompanying drawings of the embodiments of the present disclosure. Apparently, the described embodiments are only a part but not all of the embodiments of the present disclosure. Moreover, the embodiments in the present disclosure and characteristics in the embodiments can be mutually combined without conflict. Based upon the described embodiments of the present disclosure, all of the other embodiments obtained by those skilled in the art without any creative effort shall all fall within the protection scope of the present disclosure.

Unless otherwise defined, the technical or scientific terms used in the present disclosure shall have a general meaning understood by those skilled in the art to which the present disclosure belongs. The terms "first", "second" and the like used in the present disclosure do not indicate any order, quantity, or importance, but are merely intended to distinguish different components. Words like "include" or "including" mean that the element or object preceding the word covers the element or object listed after the word and its equivalent, without excluding other elements or objects. Words like "connection" or "connected" are not limited to physical or mechanical connections, but can include electrical connections, whether direct or indirect.

It should be noted that, in the drawings, the size and shape of each figure do not reflect the true proportion, merely aiming at schematically illustrating the content of the present disclosure. Moreover, the same or similar reference numerals throughout the text represent the same or similar elements or the element with the same or similar functions.

An embodiment of the present disclosure provides a drive circuit, as shown in FIG. 1, the drive circuit can include:

a current control circuit 10, configured to provide a drive signal to a device DL to be driven according to the signal of a data signal terminal DA;

a first transistor M1, electrically connected between the current control circuit 10 and the device DL to be driven; and a duration control circuit 20, electrically connected with a gate of the first transistor M1, and configured to provide a light-emitting duration modulating signal to the gate of the first transistor M1 according to a combined action of signals of a scanning signal terminal SC, a light-emitting control signal terminal EM, a duration control signal terminal SM and a reference voltage signal terminal VREF, to control the conduction duration of the first transistor M1.

As to the drive circuit provided in the embodiment of the present disclosure, a drive signal which drives the device to be driven to operate can be generated by the current control circuit. A light-emitting duration modulating signal which is provided to a gate of the first transistor can be generated by the duration control circuit, to control the conduction duration of the first transistor, and further to control the duration during which the device to be driven receives the drive signal. Moreover, in this way, the drive signal input into the device to be driven and the conduction duration of the first transistor can be separately controlled, such that the conduction duration of the first transistor can be independently controlled, and further the adjustment range of the duration of the drive signal input into the device to be driven can be larger.

During specific implementation, the device to be driven can be a light-emitting device, and the drive signal can serve as a drive current which drives the light-emitting device to emit light. In this way, by controlling the conduction duration of the first transistor, the duration of the drive current flowing into the light-emitting device is controlled to control the light-emitting duration of the light-emitting device. And further, the light-emitting duration of the light-emitting device within a frame may be controlled. Since different light-emitting durations can correspond to different gray scales, more gray scales can be displayed by controlling the light-emitting duration, thereby improving the display effect. Of course, during practical applications, the device to be driven can also be other devices, which is not defined herein. The device to be driven being a light-emitting device is taken as an example for illustration below.

During specific implementation, in the embodiment of the present disclosure, a first terminal of the light-emitting device is electrically connected with a second end of a first transistor M1, and a second terminal of the light-emitting device is electrically connected with a second power terminal VSS. Wherein the first terminal of the light-emitting device is a positive pole, while the second terminal is a negative pole. Moreover, the light-emitting device is generally an electroluminescent diode. For example, the light-emitting device can include: at least one of a micro light emitting diode (micro LED), an organic light emitting diode (OLED), and a quantum dot light emitting diode (QLED). In addition, generally, light-emitting devices have a light-emitting threshold voltage, and light is emitted when the voltage at two terminals of a light-emitting device is larger than or equal to a light-emitting threshold voltage. During practical applications, the specific structure of the light-emitting device can be designed and determined according to practical application environments, which is not defined herein.

Figure 2:
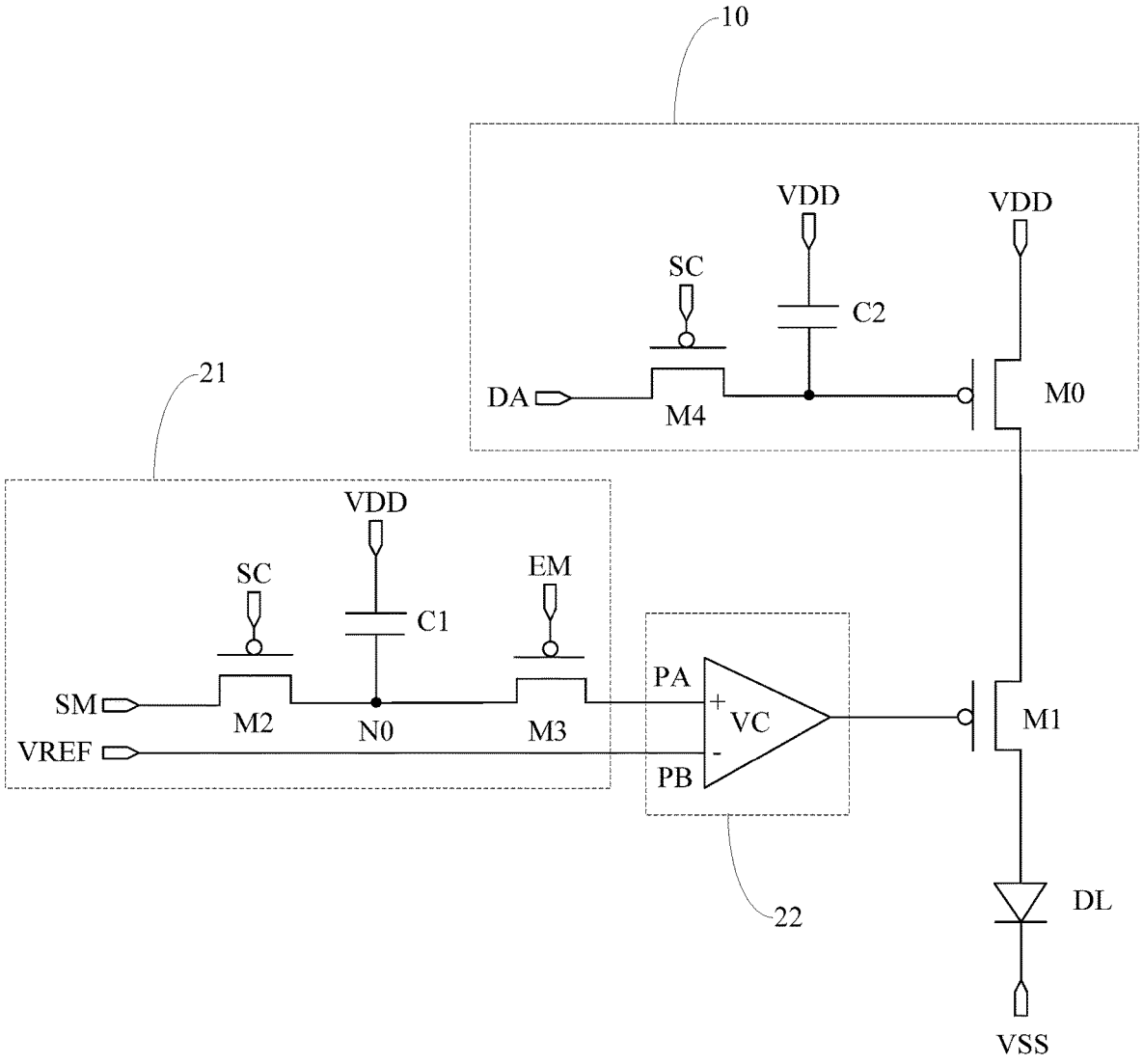
FIG. 2 is a schematic diagram of some specific structures of the drive circuit provided in the embodiment of the present disclosure.

During specific implementation, in the embodiment of the present disclosure, as shown in FIG. 2, the duration control circuit 20 can include: an input control sub-circuit 21 and a comparison sub-circuit 22; wherein the input control sub-circuit 21 is configured to provide a signal of the duration control signal terminal SM to a connection node NO in response to a signal of the scanning signal terminal SC, and provide a signal of the connection node NO to the comparison sub-circuit 22 in response to a signal of the light-emitting control signal terminal EM; and the comparison sub-circuit 22 is configured to output the light-emitting duration modulating signal according to a signal output by the input control sub-circuit 21 and a signal of the reference voltage signal terminal VREF.

During specific implementation, in the embodiment of the present disclosure, as shown in FIG. 2, the input control sub-circuit 21 can include: a second transistor M2, a third transistor M3 and a first capacitor C1; wherein a gate of the second transistor M2 is electrically connected with the scanning signal terminal SC, a first end of the second transistor M2 is electrically connected with the duration control signal terminal SM, and a second end of the second transistor M2 is electrically connected with the connection node NO;

a gate of the third transistor M3 is electrically connected with the light-emitting control signal terminal EM, a first end of the third transistor M3 is electrically connected with the connection node NO, and a second end of the third transistor M3 is electrically connected with the comparison sub-circuit 22;

the first capacitor C1 is electrically connected between a first power terminal VDD and the connection node NO.

During specific implementation, in the embodiment of the present disclosure, when the second transistor M2 is turned on under the control of the scanning signal terminal SC, the second transistor M2 can provide the signal of the duration control signal terminal SM to the connection node NO. When the third transistor M3 is turned on under the control of the light-emitting control signal terminal EM, the third transistor M3 can electrically connect the connection node NO with the comparison sub-circuit 22, to provide the signal of the connection node NO to the comparison sub-circuit 22. The first capacitor C1 can store the signals of the first power terminal VDD and the input connecting node NO.

During specific implementation, in the embodiment of the present disclosure, as shown in FIG. 2, the comparison sub-circuit 22 can include a comparator VC. Wherein an in-phase input PA of the comparator VC is electrically connected with the input control sub-circuit 21, an anti-phase input PB of the comparator VC is electrically connected with the reference voltage signal terminal VREF, and an output of the comparator VC is electrically connected with the gate of the first transistor M1. Specifically, the in-phase input PA of the comparator VC is electrically connected with a second end of the third transistor M3 in the input control sub-circuit 21.

During specific implementation, in the embodiment of the present disclosure, when a voltage of the in-phase input PA of the comparator VC is larger than a voltage of the anti-phase input PB, the output of the comparator VC outputs a high-level signal. When the voltage of the in-phase input PA of the comparator VC is smaller than the voltage of the anti-phase input PB, the output of the comparator VC outputs a low-level signal.

Figure 3:
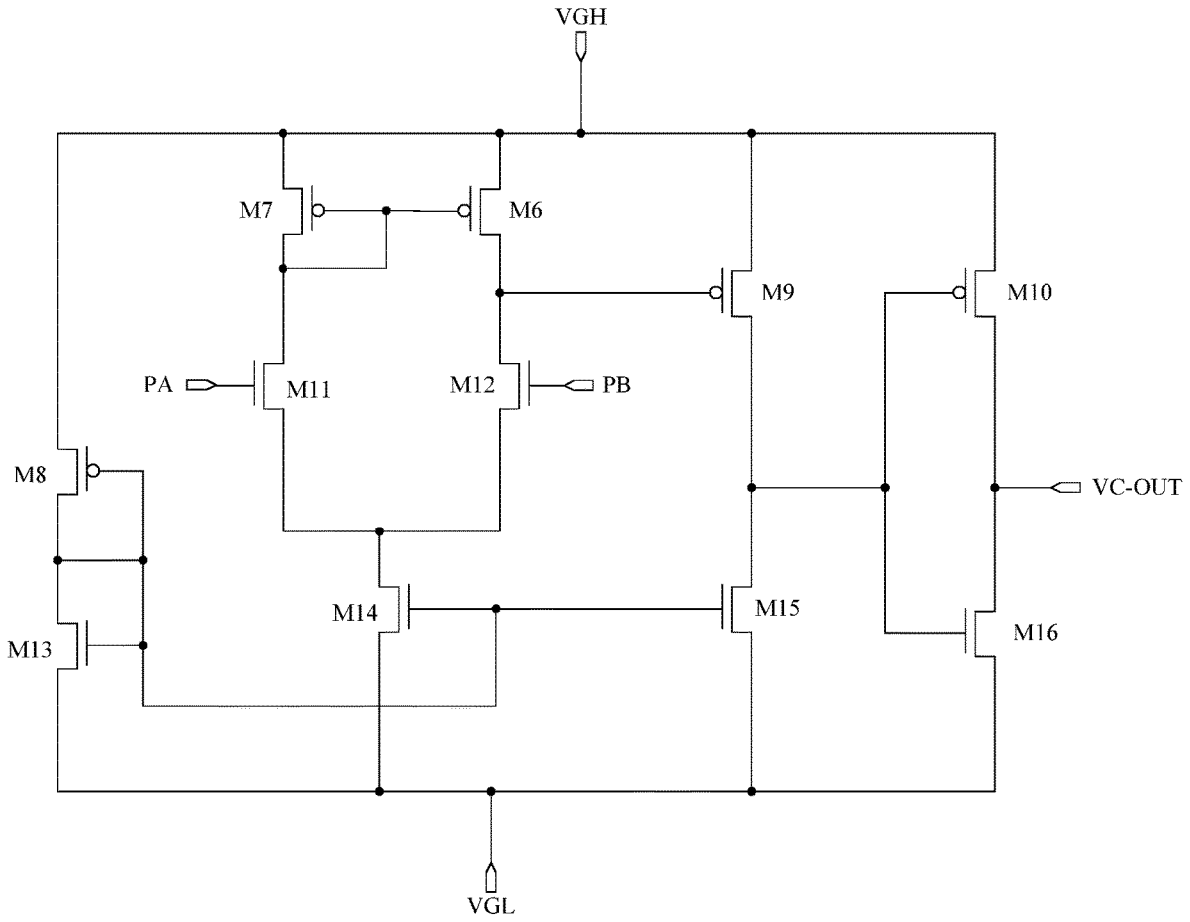
FIG. 3 is a schematic diagram of a specific structure of a comparator provided in the embodiment of the present disclosure.

Optionally, during specific implementation, in the embodiment of the present disclosure, as shown in FIG. 3, the comparator VC can include: a sixth transistor M6, a seventh transistor M7, an eighth transistor M8, a ninth transistor M9, a tenth transistor M10, an eleventh transistor M11, a twelfth transistor M12, a thirteenth transistor M13, a fourteenth transistor M14, a fifteenth transistor M15 and a sixteenth transistor M16.

A first end of the seventh transistor M7 is electrically connected with a first voltage signal terminal VGH, and a gate and a second end of the seventh transistor M7 are electrically connected with a first end of the eleventh transistor M11.

A gate of the eleventh transistor M11 serves as the in-phase input PA of the comparator VC, and the second end of the eleventh transistor M11 is electrically connected with a first end of the fourteenth transistor M14.

A first end of the sixth transistor M6 is electrically connected with the first voltage signal terminal VGH, a gate of the sixth transistor M6 is electrically connected with the gate of the seventh transistor M7, and the second end of the sixth transistor M6 is electrically connected with a first end of the twelfth transistor M12.

A gate of the twelfth transistor M12 serves as the anti-phase input PB of the comparator VC, and a second end of the twelfth transistor M12 is electrically connected with a first end of the fourteenth transistor M14.

A gate of the fourteenth transistor M14 is electrically connected with a gate of the fifteenth transistor M15 and a gate of the thirteenth transistor M13, respectively, and the second end of the fourteenth transistor M14 is electrically connected with a second voltage signal terminal VGL.

A first end of the eighth transistor M8 is electrically connected with the first voltage signal terminal VGH, and a gate and a second end of the eighth transistor M8 are respectively electrically connected with the gate and a first end of the thirteenth transistor M13.

A second end of the thirteenth transistor M13 is electrically connected with the second voltage signal terminal VGL.

A gate of the ninth transistor M9 is electrically connected with a first end of the twelfth transistor M12, a first end of the ninth transistor M9 is electrically connected with the first voltage signal terminal VGH, and a second end of the ninth transistor M9 is electrically connected with a first end of the fifteenth transistor M15, a gate of the tenth transistor M10 and a gate of the sixteenth transistor M16, respectively.

A second end of the fifteenth transistor M15 is electrically connected with the second voltage signal terminal VGL.

A first end of the tenth transistor M10 is electrically connected with the first voltage signal terminal VGH, and a second end of the tenth transistor M10 is electrically connected with a first end of the sixteenth transistor M16, and serves as an output VC-OUT of the comparator VC.

A second end of the sixteenth transistor M16 is electrically connected with the second voltage signal terminal VGL.

During specific implementation, the sixth transistor to the tenth transistor M6-M10 can be P-type transistors. The eleventh transistor to the sixteenth transistor M11-M16 can be N-type transistors. Of course, during practical applications, the specific types and structures of the above transistors can be set according to practical application environments, which are not defined herein.

During specific implementation, the voltage of the first voltage signal terminal VGH is larger than the voltage of the second voltage signal terminal VGL. For example, the first voltage signal terminal VGH and the first power terminal VDD can be a same signal terminal. Of course, during practical applications, the voltage of the first voltage signal terminal VGH and the voltage of the second voltage signal terminal VGL can be designed and determined according to practical application environments, which are not specifically defined herein.

Of course, during practical applications, the structure and working principle of the comparator VC can also be basically identical to those of the other comparators in the related technology, which are not repeated redundantly herein.

During specific implementation, in the embodiment of the present disclosure, as shown in FIG. 2, the current control circuit 10 can include a drive transistor M0, a fourth transistor M4 and a second capacitor C2.

A gate of the fourth transistor M4 is electrically connected with the scanning signal terminal SC, a first end of the fourth transistor M4 is electrically connected with the data signal terminal DA, and a second end of the fourth transistor M4 is electrically connected with the gate of the drive transistor M0.

A first end of the drive transistor M0 is electrically connected with the first power terminal VDD, and a second end of the drive transistor M0 is electrically connected with the first end of the first transistor M1.

The second capacitor C2 is electrically connected between the gate of the drive transistor M0 and the first power terminal VDD.

During specific implementation, in the embodiment of the present disclosure, when the fourth transistor M4 is turned on under the control of the scanning signal terminal SC, the fourth transistor M4 can provide the signal of the data signal terminal DA to the gate of the drive transistor M0. The second capacitor C2 can store the signals of the gate of the drive transistor M0 and the first power terminal VDD. In this way, the structure of the pixel circuit is relatively simple, thereby reducing the occupied space, and lowering the process complexity.

During specific implementation, in the embodiment of the present disclosure, as shown in FIG. 2, the drive transistor M0 can be a P-type transistor, wherein the first end of the drive transistor M0 is a source, the second end of the drive transistor M0 is a drain, and when the drive transistor M0 is in a saturated state, current flows from the source of the drive transistor M0 to the drain of the drive transistor M0.

Of course, during specific implementation, in the embodiment of the present disclosure, the drive transistor can also be an N-type transistor, wherein the first end of the drive transistor is a drain, the second end of the drive transistor is a source, and when the drive transistor is in a saturated state, current flows from the drain of the drive transistor to the source of the drive transistor.

During specific implementation, in the embodiment of the present disclosure, the current control circuit can also be a pixel compensation circuit which can compensate the threshold voltage $V_{th}$ of the drive transistor M0. The structure and working principle of the pixel compensation circuit can also be basically identical to those in the related technology, which are not repeated redundantly herein.

The specific structure of each circuit in the drive circuit provided in the embodiment of the present disclosure is merely illustrated with examples above, during specific implementation, the specific structure of the above circuit is not limited to the above structure provided in the embodiment of the present disclosure, and can also be other structures known to those skilled in the art. These are all in the protection scope of the present disclosure, and will not be defined specifically herein.

Optionally, to reduce the preparation process, during specific implementation, in the embodiment of the present disclosure, as shown in FIG. 2, the first to the fourth transistors M1 to M4 can be all P-type transistors. Of course, the first to the fourth transistors M1 to M4 can also be N-type transistors, which can also be designed and determined according to practical application environments, and will not be defined herein.

Further, during specific implementation, in the embodiment of the present disclosure, the P-type transistor is turned off under the effect of a high-level signal, and is turned on under the effect of a low-level signal. The N-type transistor is turned on under the effect of a high-level signal, and is turned off under the effect of a low-level signal.

It should be noted that, the transistor mentioned in the above embodiment of the present disclosure can be a thin film transistor (TFT), and can also be a metal oxide semiconductor (MOS) field-effect transistor, which is not defined herein.

During specific implementation, the first end of the transistor can serve as a source and the second end can serve as a drain according to the type of the transistor and the signal of the gate; or, otherwise, the first end of the transistor can serve as a drain, and the second end can serve as a source, which can be designed and determined according to practical application environments, which will not be specifically distinguished herein.

During specific implementation, in the embodiment of the present disclosure, the voltage $V_{dd}$ of the first power terminal is generally positive, and the voltage $V_{ss}$ of the second power terminal is generally grounded or is negative. During practical application, specific numerical values of the voltage $V_{dd}$ of the first power terminal and the voltage $V_{ss}$ of the second power terminal can be designed and determined according to practical application environments, which will not be defined herein.

Figure 4A:
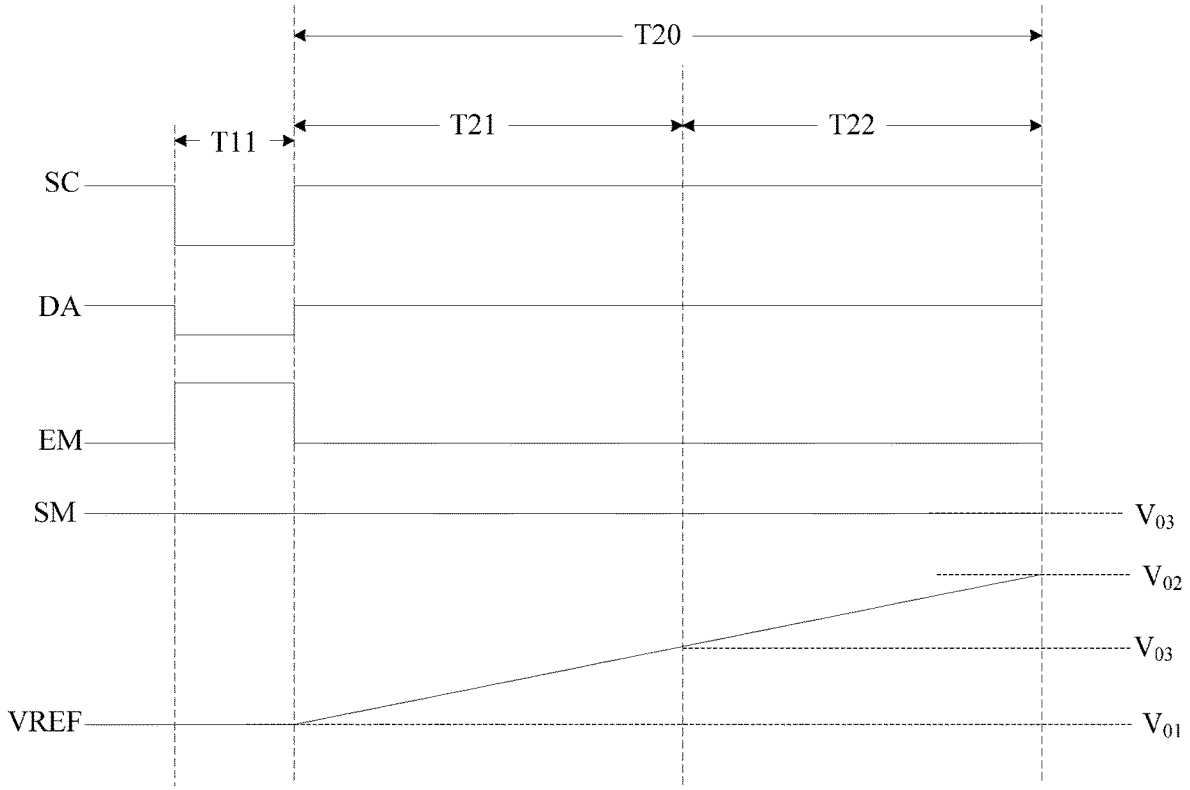
FIG. 4A is sequence chart of some circuits of the drive circuit provided in the embodiment of the present disclosure.
Figure 4B:
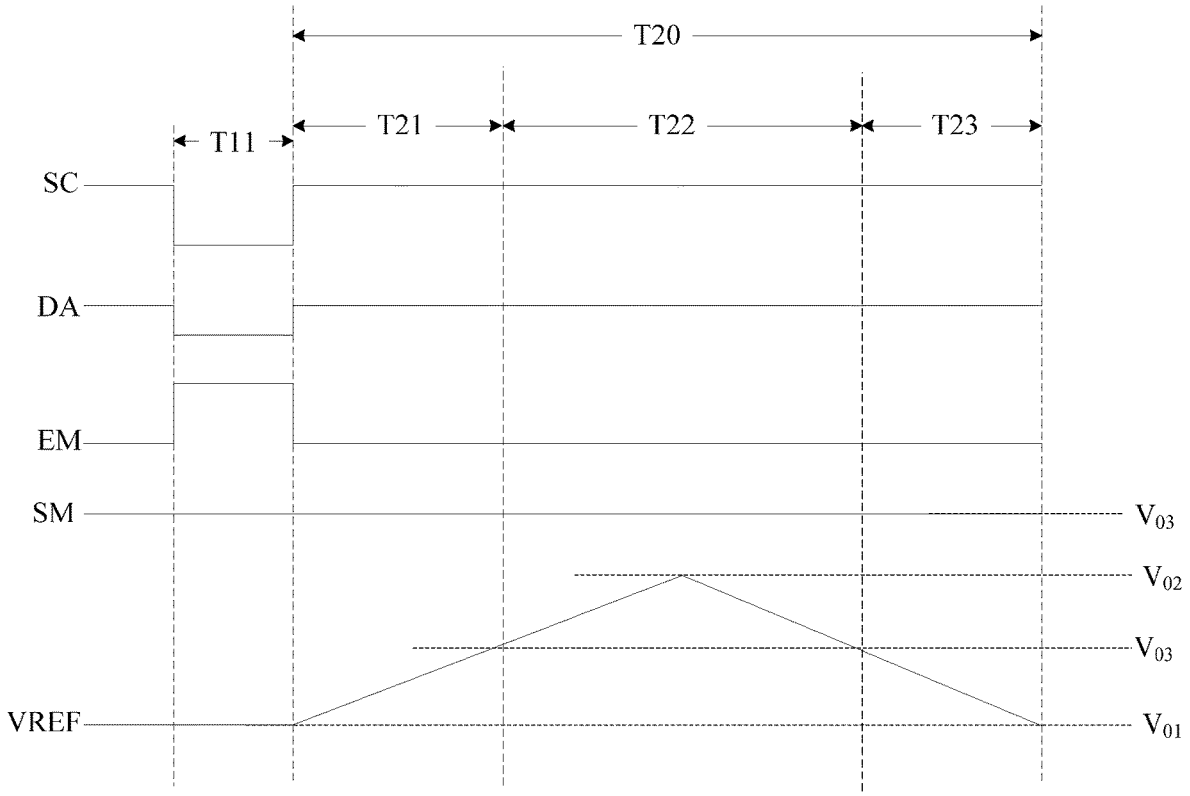
FIG. 4B is a sequence chart of some other circuits of the drive circuit provided in the embodiment of the present disclosure.
Figure 4C:
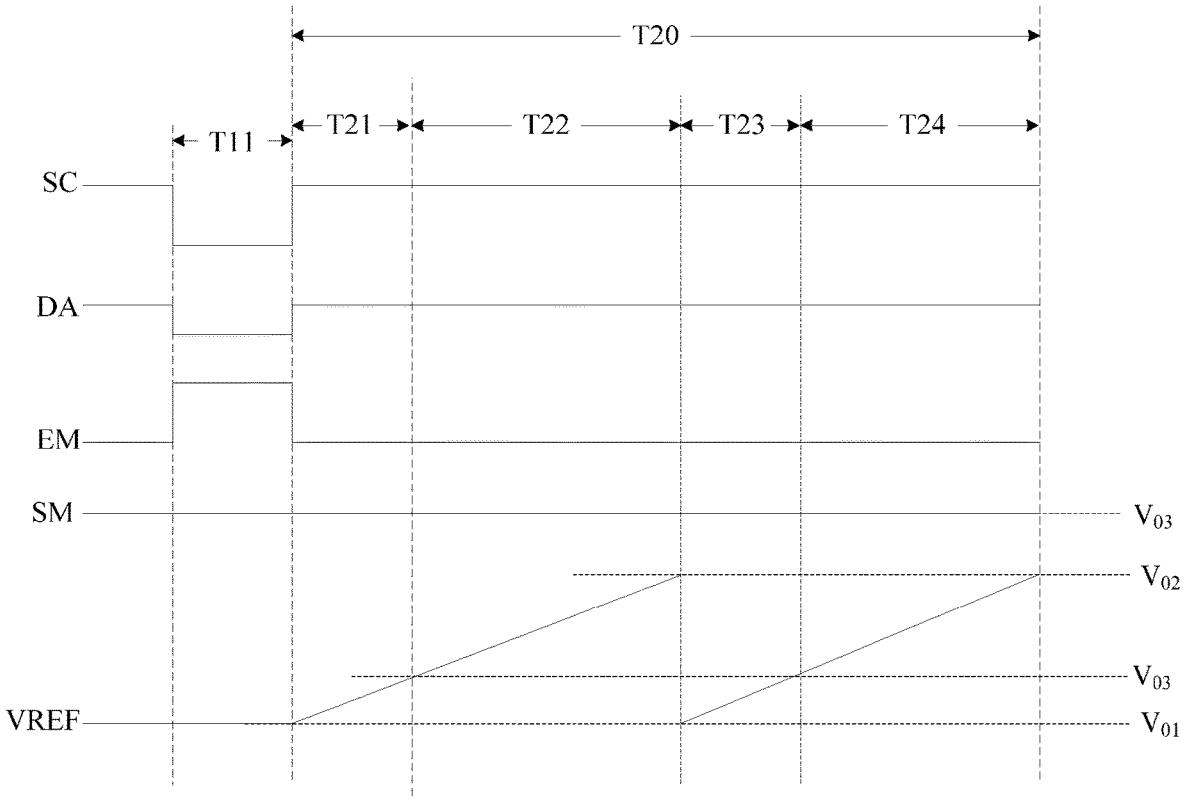
FIG. 4C is a sequence chart of still some other circuits of the drive circuit provided in the embodiment of the present disclosure.

During specific implementation, in the embodiment of the present disclosure, the voltage $V_{ref}$ of the reference voltage signal terminal VREF can be changed monotonously in a preset duration. Exemplarily, as shown in FIG. 4A, the voltage $V_{ref}$ of the reference voltage signal terminal VREF can be increased from the first voltage $V_{01}$ to the second voltage $V_{02}$ within a preset duration. Exemplarily, as shown in FIG. 4B, the voltage $V_{ref}$ of the reference voltage signal terminal VREF can be increased from the first voltage $V_{01}$ to the second voltage $V_{02}$ within a first preset duration, and can be reduced to the first voltage $V_{01}$ from the second voltage $V_{02}$ within a second preset duration. Wherein the first preset duration and the second preset duration appear continuously. Exemplarily, as shown in FIG. 4C, the voltage $V_{ref}$ of the reference voltage signal terminal VREF can be increased from the first voltage $V_{01}$ to the second voltage $V_{02}$ within a first preset duration, then drops from the second voltage $V_{02}$ to the first voltage $V_{01}$, and increases from the first voltage $V_{01}$ to the second voltage $V_{02}$ within a second preset duration. Wherein, the first preset duration and the second preset duration appear continuously. It should be noted that, the first preset duration and the second preset duration can be same, and can also be different, which is not defined herein.

During specific implementation, in the embodiment of the present disclosure, the voltage $V_{ref}$ of the reference voltage signal terminal VREF can be reduced to the first voltage $V_{01}$ from the second voltage $V_{02}$ within a preset duration. Of course, during practical applications, the voltage changing conditions of the reference voltage signal terminal VREF can be designed and determined according to practical application environments, which will not be defined herein.

During specific implementation, in the embodiment of the present disclosure, the voltage of the duration control signal terminal SM can be a fixed voltage and is within the monotonously changed range of the voltage of the reference voltage signal terminal VREF. Exemplarily, the voltage of the duration control signal terminal SM can be a fixed voltage larger than or equal to the first voltage $V_{01}$ and smaller than or equal to the second voltage $V_{02}$. For example, the voltage $V_{03}$ of the duration control signal terminal SM can be larger than $V_{01}$ and smaller than $V_{02}$. The voltage of the duration control signal terminal SM can be equal to the first voltage $V_{01}$. The voltage of the duration control signal terminal SM can also be equal to the second voltage $V_{02}$. During practical applications, the specific numerical values of the first voltage $V_{01}$, the second voltage $V_{02}$ and the voltage of the duration control signal terminal SM can be designed and determined according to practical application environments, and will not be defined herein. The working process of the drive circuit provided in the embodiment of the present disclosure will be described below in combination with the sequence chart of a circuit shown in FIG. 4A and with the structure of the drive circuit shown in FIG. 2 as an example.

Wherein the signal input sub-stage T11 and the light-emitting stage T20 in the sequence chart of the circuit shown in FIG. 4A are primarily selected. It should be noted that, the voltage of the reference voltage signal terminal VREF can be increased from the first voltage $V_{01}$ to the second voltage $V_{02}$ within a preset duration, and the voltage $V_{03}$ of the duration control signal terminal SM can be a fixed voltage which is larger than the first voltage $V_{01}$ and smaller than the second voltage $V_{02}$.

Moreover, the working process of the drive circuit within a frame can include a signal input sub-stage T11 and a light-emitting stage T20, wherein the light-emitting stage T20 can include: a modulating sub-stage T21 and a light-emitting sub-stage T22.

In the signal input sub-stage T11, the scanning signal terminal SC has a low-level signal which can turn on the second transistor M2 and the fourth transistor M4. The light-emitting control signal terminal EM has a high-level signal which can turn off the third transistor M3. The fourth transistor M4 turned on can provide the signal of the data signal terminal DA to the gate of the drive transistor M0, and the signal of the data signal terminal DA can be stored in a second capacitor C2. Since the gate voltage of the drive transistor M0 is the voltage $V_{DA}$ of the signal of the data signal terminal DA and the source voltage of the drive transistor M0 is $V_{dd}$, the drive transistor M0 can generate a drive current I, and $I=K(V_{sg}-|V_{th}|)^2=K(V_{dd}-V_{DA}-|V_{th}|)^2$. Wherein $V_{sg}$ is a source-to-gate voltage of the drive transistor M0, and K is a structural parameter. The numerical value of K is relatively stable in the same structure, and can serve as a constant. The second transistor M2 turned on can provide the signal of the duration control signal terminal SM to the connection node NO such that the voltage of the signal of the connection node NO is $V_{03}$, and is stored in the first capacitor C1.

In the modulating sub-stage T21, the scanning signal terminal SC has a high-level signal which can turn off the second transistor M2 and the fourth transistor M4. The light-emitting control signal terminal EM has a low-level signal which can turn on the third transistor M3. The third transistor M3 turned on can provide the signal input into the connection node NO to the in-phase input PA of the comparator AC, such that the voltage of the in-phase input PA of the comparator AC is $V_{03}$. Since the voltage of the anti-phase input PB of the comparator AC is increased to $V_{03}$ from $V_{01}$, the voltage of the in-phase input PA is larger than the voltage of the anti-phase input PB, such that an output of the comparator AC outputs a high-level signal. Since the comparator AC outputs the high-level signal which can turn off the first transistor M1, the light-emitting device DL stops emitting light in the modulating sub-stage T21.

In the light-emitting sub-stage T22, the scanning signal terminal SC has a high-level signal which can turn off the second transistor M2 and the fourth transistor M4. The light-emitting control signal terminal EM has a low-level signal which can turn on the third transistor M3. The third transistor M3 turned on can provide the signal input into the connection node NO to the in-phase input PA of the comparator AC, such that the voltage of the in-phase input PA of the comparator AC is $V_{03}$. Since the voltage of the anti-phase input PB of the comparator AC is increased to $V_{01}$ from $V_{03}$, the voltage of the in-phase input PA is smaller than the voltage of the anti-phase input PB, such that the output of the comparator AC outputs a low-level signal. Since the comparator AC outputs the low-level signal which can turn on the first transistor M1, the drive current I generated by the drive transistor M0 can be provided to the light-emitting device DL, to drive the light-emitting device DL to emit light in the light-emitting sub-stage T22.

Figure 5:
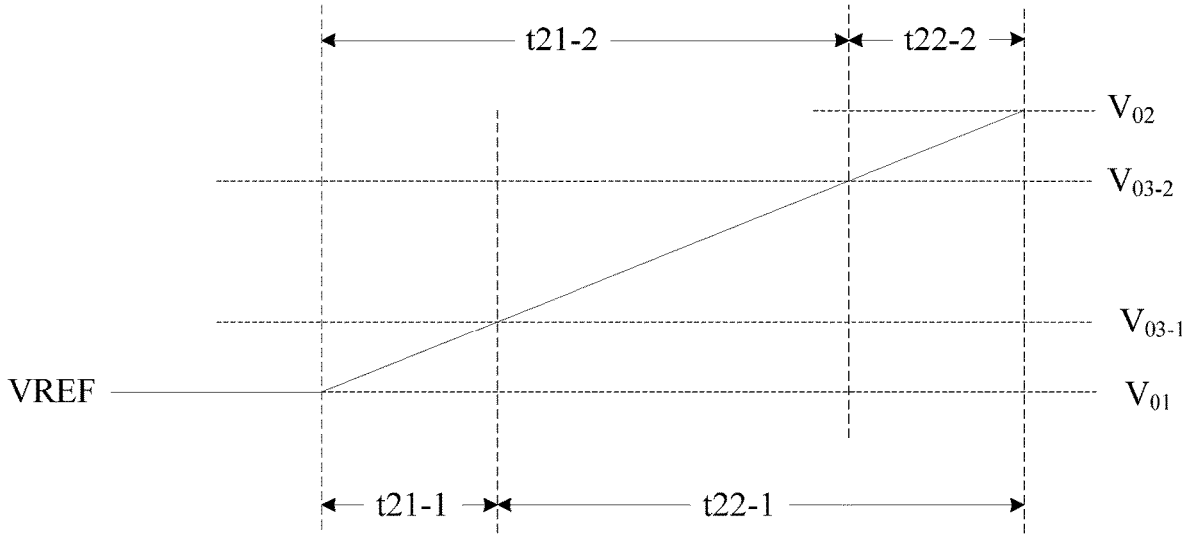
FIG. 5 is a schematic diagram of the relationship between the voltage of a reference voltage signal terminal and the voltage of a duration control signal terminal provided in the embodiment of the present disclosure.

It can be known from the working process in the modulating sub-stage T21 and the light-emitting sub-stage T22 that, the duration of the modulating sub-stage T21 and the duration of the light-emitting sub-stage T22 can be controlled through the magnitude of the voltage $V_{03}$ of the duration control signal terminal SM. For example, in combination with FIG. 5, when the voltage of the duration control signal terminal SM is $V_{03-1}$, the duration of the light-emitting sub-stage T22 is t22-1 and the duration of the modulating sub-stage T21 is t21-1. When the voltage of the duration control signal terminal SM is $V_{03-2}$, the duration of the light-emitting sub-stage T22 is t22-2 and the duration of the modulating sub-stage T21 is t21-2. Wherein $V_{03-1}$ is smaller than $V_{03-2}$. Therefore, it can be seen that, when the voltage of the duration control signal terminal SM is increased, the duration of the light-emitting sub-stage T22 can be reduced. Otherwise, when the voltage of the duration control signal terminal SM is reduced, the duration of the light-emitting sub-stage T22 can be increased. Therefore, during practical applications, the light-emitting duration of the light-emitting device DL can be controlled through adjusting the voltage of the duration control signal terminal SM, thereby displaying more gray scales through controlling the light-emitting duration, and improving the display effect.

The working process of the drive circuit provided in the embodiment of the present disclosure will be described below in combination with the sequence chart of a circuit shown in FIG. 4B and with the structure of the drive circuit shown in FIG. 2 as an example. Only the differences from the above embodiments are described below, and the same parts are not repeated redundantly herein.

The light-emitting stage T20 can include a modulating sub-stage T21, a light-emitting sub-stage T22 and a modulating sub-stage T23. Wherein for the working process in the modulating sub-stage T21, please refer to the working process in the above embodiment of FIG. 4A, which will not be repeated redundantly herein.

In a preceding time period in the light-emitting sub-stage T22, the scanning signal terminal SC has a high-level signal which can turn off the second transistor M2 and the fourth transistor M4. The light-emitting control signal terminal EM has a low-level signal which can turn on the third transistor M3. The third transistor M3 turned on can provide the signal input into the connection node NO to the in-phase input PA of the comparator AC, such that the voltage of the in-phase input PA of the comparator AC is $V_{03}$. Since the voltage of the anti-phase input PB of the comparator AC is increased from $V_{03}$ to $V_{02}$, the voltage of the in-phase input PA is smaller than the voltage of the anti-phase input PB, such that the output of the comparator AC outputs a low-level signal. Since the comparator AC outputs the low-level signal, the first transistor M1 can be turned on, the drive circuit I generated by the drive transistor M0 can be provided to the light-emitting device DL, to drive the light-emitting device DL to emit light.

In a later time period in the light-emitting sub-stage T22, the scanning signal terminal SC has a high-level signal, which can turn off the second transistor M2 and the fourth transistor M4. The light-emitting control signal terminal EM has a low-level signal which can turn on the third transistor M3. The third transistor M3 turned on can provide the signal input into the connection node NO to the in-phase input PA of the comparator AC, such that the voltage of the in-phase input PA of the comparator AC is $V_{03}$. Since the voltage of the anti-phase input PB of the comparator AC is decreased from $V_{02}$ to $V_{03}$, the voltage of the in-phase input PA is smaller than the voltage of the anti-phase input PB, such that the output of the comparator AC outputs a low-level signal. Since the comparator AC outputs the low-level signal, the first transistor M1 can be turned on, such that the drive circuit I generated by the drive transistor M0 can be provided to the light-emitting device DL, to drive the light-emitting device DL to emit light.

In a modulating sub-stage T23, the scanning signal terminal SC has a high-level signal which can turn off the second transistor M2 and the fourth transistor M4. The light-emitting control signal terminal EM has a low-level signal, which can turn on the third transistor M3. The third transistor M3 turned on can provide the signal input into the connection node NO to the in-phase input PA of the comparator AC, such that the voltage of the in-phase input PA of the comparator AC is $V_{03}$. Since the voltage of the anti-phase input PB of the comparator AC is decreased to $V_{01}$ from $V_{03}$, the voltage of the in-phase input PA is larger than the voltage of the anti-phase input PB, such that the output of the comparator AC outputs a high-level signal. Since the comparator AC outputs the high-level signal which can turn off the first transistor M1, the light-emitting device DL stops emitting light in the modulating sub-stage T23.

The working process of the drive circuit provided in the embodiment of the present disclosure will be described below in combination with the sequence chart of a circuit shown in FIG. 4C and with the structure of the drive circuit shown in FIG. 2 as an example. Only the differences from the above embodiments are described below, and the same parts are not repeated redundantly herein.

The light-emitting stage T20 can include a modulating sub-stage T21, a light-emitting sub-stage T22, a modulating sub-stage T23 and a light-emitting sub-stage T22. Wherein for the working process in the modulating sub-stage T21 and the light-emitting sub-stage T22, please refer to the working process in the modulating sub-stage T21 and the light-emitting sub-stage T22 in the above embodiment of FIG. 4A. Moreover, for the working process in the modulating sub-stage T23, please refer to the working process in the modulating sub-stage T21 in the above embodiment of FIG. 4A. For the working process in the light-emitting sub-stage T22, please refer to the working process in the light-emitting sub-stage T22 in the above embodiment of FIG. 4A, which will not be repeated redundantly herein.

It can be seen from the above embodiments that, the light-emitting duration can be adjusted through adjusting the voltage of the reference voltage signal terminal VREF.

Figure 6:
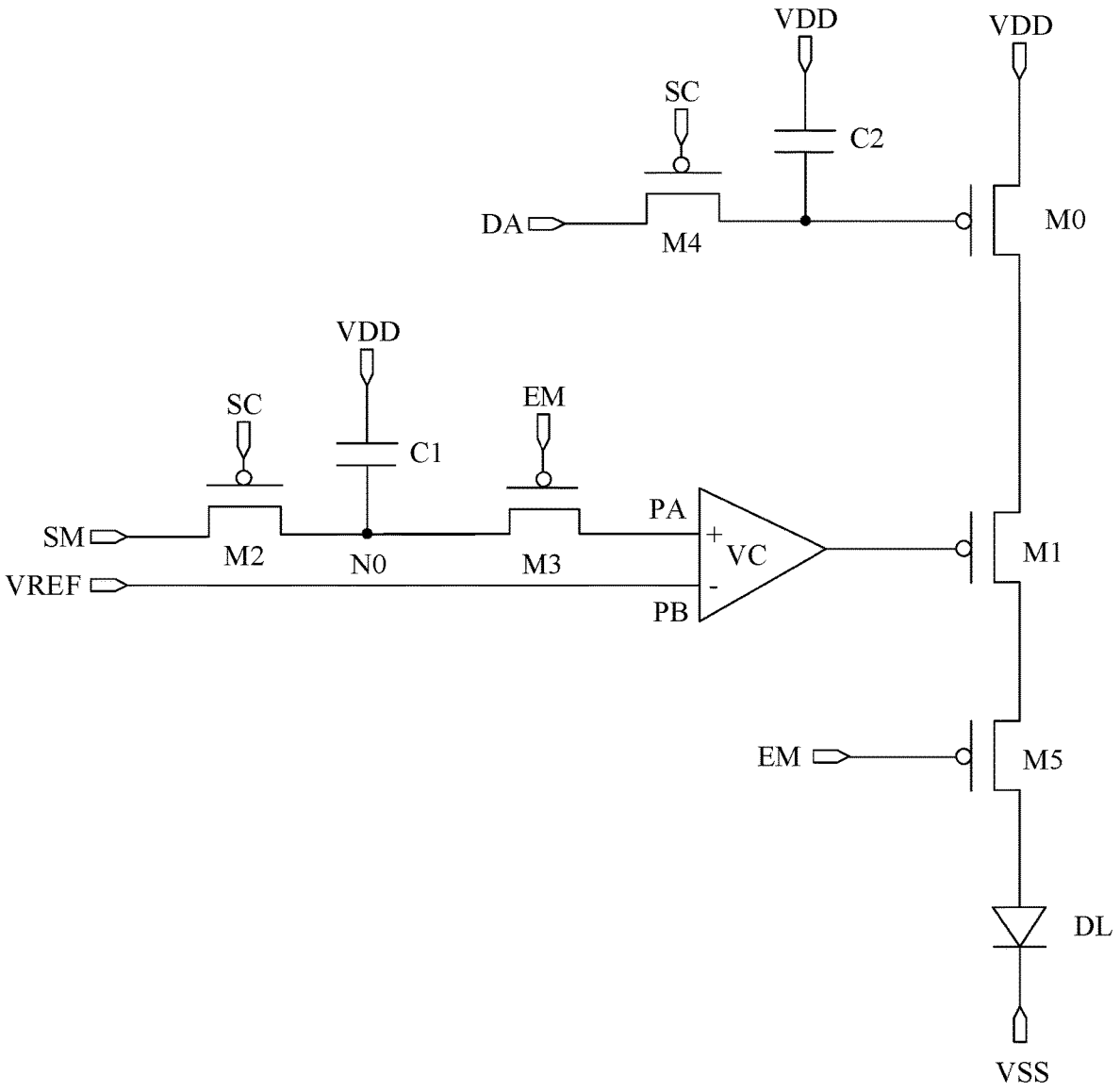
FIG. 6 is a schematic diagram of still some other specific structures of the drive circuit provided in the embodiment of the present disclosure.

The structural schematic diagram of some other drive circuits provided in the embodiment of the present disclosure is as shown in FIG. 6, which is distorted aiming at the implementing manners in the above embodiments. Only the differences from the above embodiments are described below, and the same parts are not repeated redundantly herein.

During specific implementation, in the embodiment of the present disclosure, as shown in FIG. 6, the drive circuit further includes a fifth transistor M5. Wherein the first transistor M1 is electrically connected with the device DL to be driven through the fifth transistor M5, and a gate of the fifth transistor M5 is electrically connected with the light-emitting control signal terminal EM.

In a signal input sub-stage T11, the drive transistor M0 may generate a drive current. Due to current leakage of the transistor, the first transistor M1 may leak current. The drive current generated by the drive transistor M0 flows to the light-emitting device due to current leakage of the first transistor M1, thereby enabling the light-emitting device to emit light, and lowering the display effect. In the embodiment of the present disclosure, through setting the fifth transistor M5 and turning off the fifth transistor M5 in the signal input sub-stage T11, the problem of lowered display effect due to current leakage can be improved. Moreover, through turning on the fifth transistor M5 in the light-emitting stage T20, the first transistor M1 can be conducted with the light-emitting device. Further, when the first transistor M1 is turned on, the drive current generated by the drive transistor M0 can be input into the light-emitting device, thereby driving the light-emitting device to emit light.

During specific implementation, in the embodiment of the present disclosure, the fifth transistor M5 can also be a P-type transistor or an N-type transistor, which is not defined herein.

The sequence chart of a circuit corresponding to the structure of the drive circuit shown in FIG. 6 can also be as shown in FIG. 4A, and for the specific working process, please refer to the above embodiment, which is not specifically repeated redundantly herein.

Figure 7:
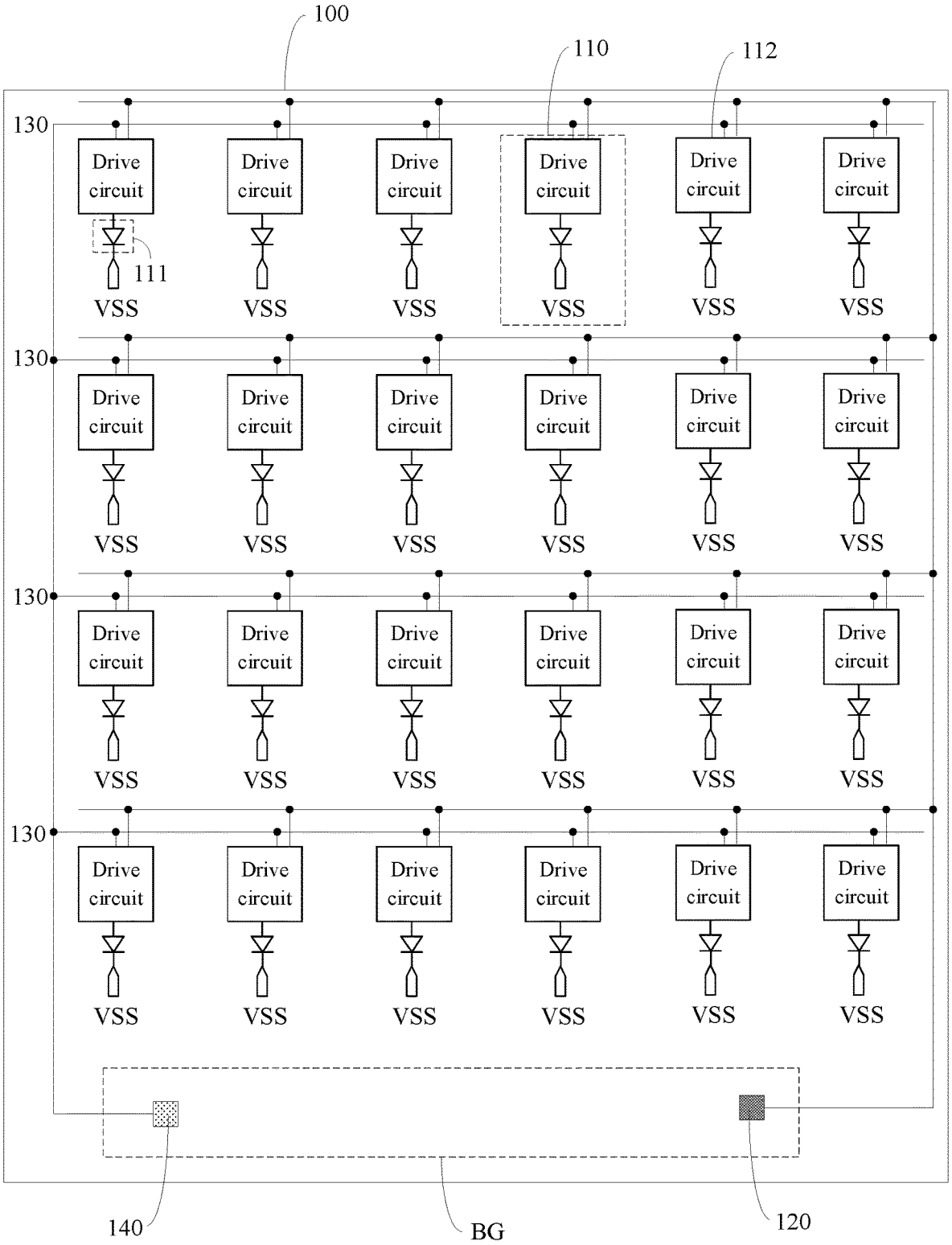
FIG. 7 is a schematic diagram of some specific structures of a display device provided in an embodiment of the present disclosure.

Based on the same inventive concept, the embodiment of the present disclosure further provides a display device, as shown in FIG. 7, the display device can include a substrate 100, and a plurality of sub-pixels 110 arranged at one side of the substrate. Wherein, at least one of the plurality of sub-pixels can include a light-emitting device 111 and the drive circuit 112 above, wherein the light-emitting device 111 serves as the device DL to be driven. Wherein for the structure and working principle of the drive circuit 112, please refer to the above embodiments, which will not be repeated redundantly herein.

Exemplarily, during specific implementation, in the embodiment of the present disclosure, the same reference voltage signal can be loaded to the reference voltage signal terminal of the drive circuit in each sub-pixel. In this way, the reference voltage signal terminals VREF of all the drive circuits 112 in the display device can adopt the same signal, thereby lowering the complexity of the circuit which outputs signal to the reference voltage signal terminal VREF, facilitating control, and reducing number of the signal lines.

Exemplarily, during specific implementation, in the embodiment of the present disclosure, in combination with FIG. 2 and FIG. 7, the display device can further include a reference voltage input 120 on the substrate 100. The reference voltage input 120 can be in the binding area BG of the substrate 100. Wherein the reference voltage signal terminal VREF of each drive circuit 112 is electrically connected with the reference voltage input 120. In this way, one reference voltage input 120 inputs the same signal to the reference voltage signal terminals VREF of all the drive circuits 112 in the display device, thereby reducing the space occupied by the reference voltage input 120.

During specific implementation, in the embodiment of the present disclosure, the same light-emitting control signal can be loaded to the light-emitting control signal terminal of the drive circuit in each sub-pixel. In this way, the light-emitting control signal terminals EM of all the drive circuits 112 in the display device can adopt the same signal, thereby lowering the complexity of the circuit which outputs signal to the light-emitting control signal terminal EM, facilitating control, and reducing number of the signal lines.

Exemplarily, during specific implementation, in the embodiment of the present disclosure, in combination with FIG. 2 and FIG. 7, the display device can further include a plurality of light-emitting control signal lines 130, and a light-emitting control input 140 in the binding area BG of the substrate 100. Wherein the light-emitting control signal terminals EM of the drive circuits 111 of a row of sub-pixels 110 are correspondingly electrically connected with one light-emitting control signal line 130; and each light-emitting control signal line 130 is electrically connected with the light-emitting control input 140. In this way, one light-emitting control input 140 inputs the same signal to the light-emitting control signal terminals EM of all the drive circuits 112 in the display device, thereby reducing the space occupied by the light-emitting control input 140.

During specific implementation, in the embodiment of the present disclosure, the display device can further include: a plurality of gate lines independent with one another, a plurality of data lines independent with one another and a plurality of duration control signal lines independent with one another. Wherein the scanning signal terminals of the drive circuits of a row of sub-pixels are correspondingly electrically connected with a gate line, the data signal terminals of the drive circuits of a column of sub-pixels are correspondingly electrically connected with a data line, and the duration control signal terminals of the drive circuits of a column of sub-pixels are correspondingly electrically connected with a duration control signal line.

During specific implementation, in the embodiment of the present disclosure, the gate line, the data line, the duration control signal line, the light-emitting control signal line, and the signal line electrically connected with the reference voltage input are respectively mutually insulated.

During specific implementation, in the embodiment of the present disclosure, each sub-pixel can be in the display area of the substrate, to realize the display effect. For example, generally, the display device includes a plurality of pixels, and at least one of the plurality of pixels can include a plurality of sub-pixels. Exemplarily, the pixel can include a red sub-pixel, a green sub-pixel and a blue sub-pixel, thereby realizing display through color mixing of red, green and blue. The pixel can also include a red sub-pixel, a green sub-pixel, a blue sub-pixel and a white sub-pixel, thereby realizing display through color mixing of red, green, blue and white.

Figure 9:
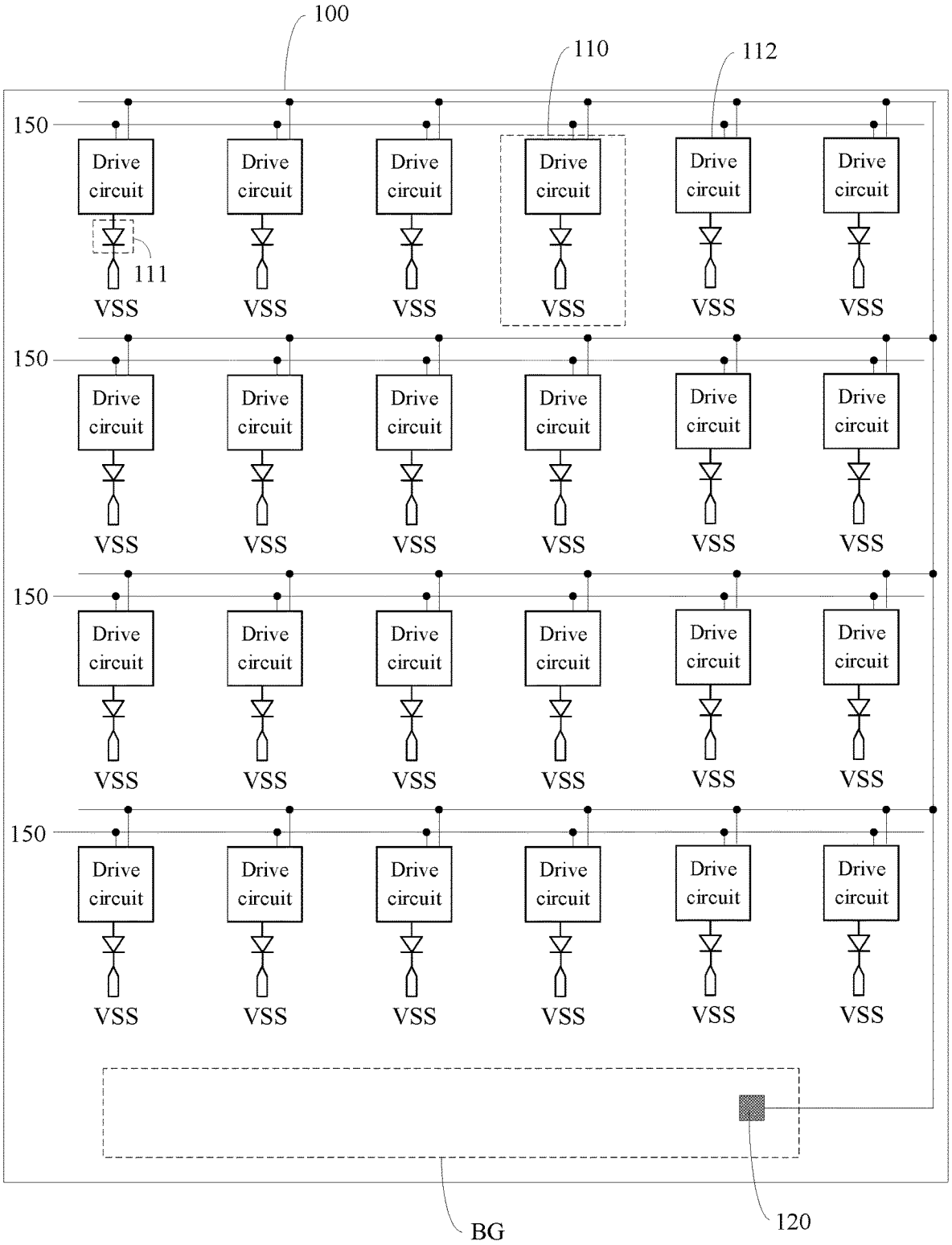
FIG. 9 is a schematic diagram of still some other specific structures of the display device provided in the embodiment of the present disclosure.

During specific implementation, in the embodiment of the present disclosure, as shown in FIG. 7 and FIG. 9, the substrate is also provided with a binding area BG. The binding area BG can be set with a terminal for binding. During practical applications, the reference voltage input 120 and the light-emitting control input 140 can be set in the binding area BG. Moreover, since only one reference voltage input 120 and one light-emitting control input 140 are arranged, the space occupying the binding area BG can be reduced.

Figure 11:
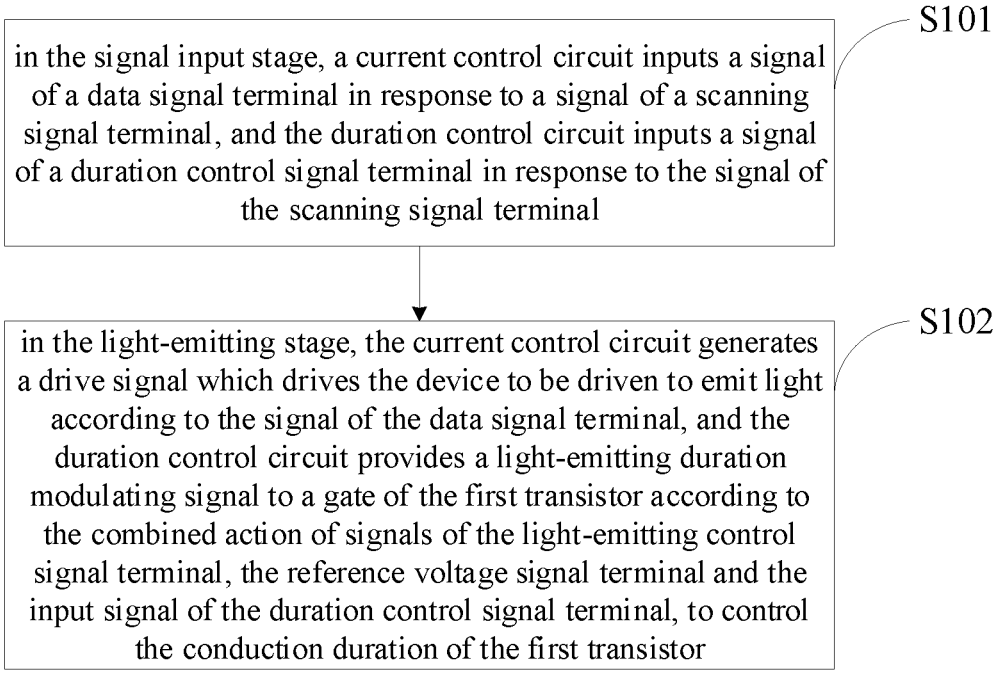
FIG. 11 is a flow chart of a driving method of the display device provided in the embodiment of the present disclosure.

Based on the same inventive concept, an embodiment of the present disclosure further provides a driving method of a display device, as shown in FIG. 11, for each row of sub-pixels, a frame includes a signal input stage and a light-emitting stage.

S101, in the signal input stage, a current control circuit inputs a signal of a data signal terminal in response to a signal of a scanning signal terminal, and the duration control circuit inputs a signal of a duration control signal terminal in response to the signal of the scanning signal terminal.

S102, in the light-emitting stage, the current control circuit generates a drive signal which drives the device to be driven to emit light according to the signal of the data signal terminal, and the duration control circuit provides a light-emitting duration modulating signal to a gate of the first transistor according to the combined action of signals of the light-emitting control signal terminal, the reference voltage signal terminal and the input signal of the duration control signal terminal, to control the conduction duration of the first transistor; wherein the voltage of the reference voltage signal terminal is changed monotonously within a preset duration, and the voltage of the duration control signal terminal is a fixed voltage and the voltage of the duration control signal terminal is within the monotonously changed range of the voltage of the reference voltage signal terminal.

Figure 8:
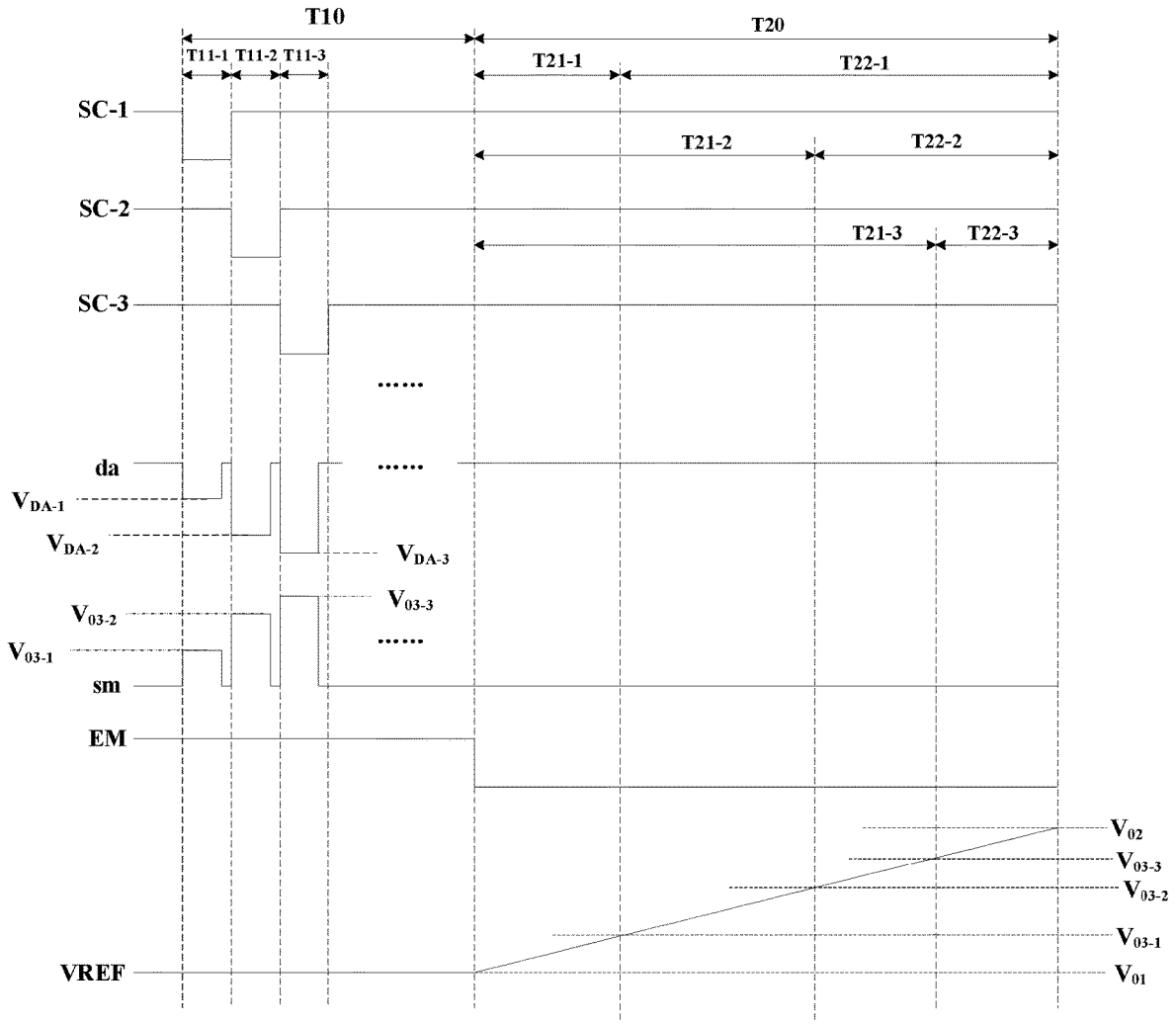
FIG. 8 is a sequence chart of some circuits of the display device provided in the embodiment of the present disclosure.

The working process of the display device provided in the embodiment of the present disclosure will be described below in combination with the sequence chart of a circuit shown in FIG. 8 with the structure shown in FIG. 6 and FIG. 7 as an example. Wherein the signal input stage T10 and the light-emitting stage T20 in the sequence chart of a circuit shown in FIG. 8 are primarily selected. It should be noted that, the voltage of the reference voltage signal terminal VREF can be increased from the first voltage $V_{01}$ to the second voltage $V_{02}$ within a preset duration, and the voltage of the duration control signal terminal SM can be a fixed voltage $V_{03}$ larger than the first voltage $V_{01}$ and smaller than the second voltage $V_{02}$.

The working stage of the display device within a frame can include a signal input stage T10 and a light-emitting stage T20. The signal input stage T10 can include a plurality of signal input sub-stages T11-*n*, wherein n is greater than or equal to 1 and less than or equal to N, N and n are both integers, and N represents the total number of rows of sub-pixels in the display device. The light-emitting stage T20 can include a modulating sub-stage T21 and a light-emitting sub-stage T22.

In the signal input stage T10, signals are loaded row by row to the scanning signal terminals of the drive circuits in the respective rows of sub-pixels, to drive the rows of sub-pixels row by row. Wherein, sub-pixels from the first row to the third row are taken as an example for illustration. SC-1 represents the signal received by the scanning signal terminal SC of the drive circuit of the first row of sub-pixels, SC-2 represents the signal received by the scanning signal terminal SC of the drive circuit of the second row of sub-pixels, and SC-3 represents the signal received by the scanning signal terminal SC of the drive circuit of the third row of sub-pixels. Further, da represents the signal transmitted in the data line, and sm represents the signal transmitted in the duration control signal line.

Specifically, in a signal input sub-stage T11-1, the first row of sub-pixels are driven. Wherein, the scanning signal terminal SC of the drive circuit in the first row of sub-pixels has a low-level signal which can turn on the second transistor M2 and the fourth transistor M4. The light-emitting control signal terminal EM has a high-level signal which can turn off the third transistor M3 and the fifth transistor M5. The fourth transistor M4 turned on can provide the signal da transmitted to the data signal terminal DA through a data line to the gate of the drive transistor M0, and the signal da is stored in the second capacitor C2. Since the gate voltage of the drive transistor M0 is the voltage $V_{DA\text{-}1}$ of the signal of the data signal terminal DA and the source voltage of the drive transistor M0 is $V_{dd}$, the drive transistor M0 can generate a drive current I, and $I=K(V_{sg}-|V_{th}|)^2=K(V_{dd}-V_{DA\text{-}1}-|V_{th}|)^2$, wherein $V_{sg}$ is a source-to-gate voltage of the drive transistor M0, and K is a structural parameter. The numerical value of K is relatively stable in the same structure, and can serve as a constant. The second transistor M2 turned on can provide the signal sm transmitted by the duration control signal line to the duration control signal terminal SM to the connection node NO, such that the voltage of the signal of the connection node NO is $V_{03\text{-}1}$, and is stored in the first capacitor C1.

In a signal input sub-stage T11-2, the second row of sub-pixels are driven. Wherein, the scanning signal terminal SC of the drive circuit in the second row of sub-pixels has a low-level signal which can turn on the second transistor M2 and the fourth transistor M4. The light-emitting control signal terminal EM has a high-level signal which can turn off the third transistor M3 and the fifth transistor M5. The fourth transistor M4 turned on can provide the signal da transmitted to the data signal terminal DA through a data line to the gate of the drive transistor M0, and the signal da is stored in the second capacitor C2. Since the gate voltage of the drive transistor M0 is the voltage $V_{DA\text{-}2}$ of the signal of the data signal terminal DA and the source voltage of the drive transistor M0 is $V_{dd}$, the drive transistor M0 can generate a drive current I, and $I=K(V_{sg}-|V_{th}|)^2=K(V_{dd}-V_{DA\text{-}2}-|V_{th}|)^2$, wherein $V_{sg}$ is a source-to-gate voltage of the drive transistor M0, and K is a structural parameter. The numerical value of K is relatively stable in the same structure, and can serve as a constant. The second transistor M2 turned on can provide the signal sm transmitted to the duration control signal terminal SM through the duration control signal line to the connection node NO, such that the voltage of the signal of the connection node NO is $V_{03\text{-}2}$, and is stored in the first capacitor C1.

In a signal input sub-stage T11-3, the third row of sub-pixels are driven. Wherein, the scanning signal terminal SC of the drive circuit in the third row of sub-pixels has a low-level signal which can turn on the second transistor M2 and the fourth transistor M4. The light-emitting control signal terminal EM has a high-level signal which can turn off the third transistor M3 and the fifth transistor M5. The fourth transistor M4 turned on can provide the signal da transmitted to the data signal terminal DA through a data line to the gate of the drive transistor M0, and the signal da is stored in the second capacitor C2. Since the gate voltage of the drive transistor M0 is the voltage $V_{DA\text{-}3}$ of the signal of the data signal terminal DA and the source voltage of the drive transistor M0 is $V_{dd}$, the drive transistor M0 can generate a drive current I, and $I=K(V_{sg}-|V_{th}|)^2=K(V_{dd}-V_{DA\text{-}3}-|V_{th}|)^2$, wherein $V_{sg}$ is a source-to-gate voltage of the drive transistor M0, and K is a structural parameter. The numerical value of K is relatively stable in the same structure, and can serve as a constant. The second transistor M2 turned on can provide the signal sm transmitted to the duration control signal terminal SM through the duration control signal line to the connection node NO, such that the voltage of the signal of the connection node NO is $V_{03\text{-}3}$, and is stored in the first capacitor C1.

Afterwards, the fourth row of sub-pixels to the last row of sub-pixels are driven in sequence, and the working processes can be analogized in sequence, which will not be repeated redundantly herein.

Then entering the light-emitting stage T20, wherein the scanning signal terminal SC of each drive circuit in the display device has a high-level signal which can turn off the second transistor M2 and the fourth transistor M4. The light-emitting control signal terminal EM in each drive circuit in the display device has a low-level signal which can turn on the third transistor M3 and the fifth transistor M5. The third transistor M3 turned on can provide the signal input to the connection node NO to the in-phase input PA of the comparator AC.

For the drive circuit in a sub-pixel in the first row of the display device, the light-emitting stage T20 can include a modulating sub-stage T21-1 and a light-emitting sub-stage T22-1. Wherein in the modulating sub-stage T21-1, the third transistor M3 turned on can provide the signal input into the connection node NO to the in-phase input PA of the comparator AC, the voltage of the in-phase input PA of the comparator AC is $V_{03\text{-}1}$. Since the voltage of the anti-phase input PB of the comparator AC is increased to $V_{03\text{-}1}$ from $V_{01}$, the voltage of the in-phase input PA is larger than the voltage of the anti-phase input PB, such that an output of the comparator AC outputs a high-level signal. Since the comparator AC outputs the high-level signal which can turn off control the first transistor M1, the light-emitting device DL stops emitting light in the modulating sub-stage T21-1.

In a light-emitting sub-stage T22-1, since the voltage of the anti-phase input PB of the comparator AC is increased from $V_{03-1}$ to $V_{02}$, the voltage of the in-phase input PA is smaller than the voltage of the anti-phase input PB, such that the output of the comparator AC outputs a low-level signal. Since the comparator AC outputs a low-level signal, the first transistor M1 can be turned on, such that the drive circuit I generated by the drive transistor M0 can be provided to the light-emitting device DL, to drive the light-emitting device DL to emit light in the light-emitting sub-stage T22-1.

For the drive circuit in a sub-pixel in the second row of the display device, the light-emitting stage T20 can include a modulating sub-stage T21-2 and a light-emitting sub-stage T22-2. Wherein in the modulating sub-stage T21-2, the third transistor M3 turned on can provide the signal input into the connection node NO to the in-phase input PA of the comparator AC, such that the voltage of the in-phase input PA of the comparator AC is $V_{03-2}$. Since the voltage of the anti-phase input PB of the comparator AC is increased to $V_{03-2}$ from $V_{01}$, the voltage of the in-phase input PA is larger than the voltage of the anti-phase input PB, such that an output of the comparator AC outputs a high-level signal. Since the comparator AC outputs the high-level signal which can turn off the first transistor M1, the light-emitting device DL stops emitting light in the modulating sub-stage T21-2.

In a light-emitting sub-stage T22-1, since the voltage of the anti-phase input PB of the comparator AC is increased from $V_{03-2}$ to $V_{02}$, the voltage of the in-phase input PA is smaller than the voltage of the anti-phase input PB, such that the output of the comparator AC outputs a low-level signal. Since the comparator AC outputs a low-level signal, the first transistor M1 can be turned on, the drive circuit I generated by the drive transistor M0 can be provided to the light-emitting device DL, to drive the light-emitting device DL to emit light in the light-emitting sub-stage T22-2.

For the drive circuit in a sub-pixel in the third row of the display device, the light-emitting stage T20 can include a modulating sub-stage T21-3 and a light-emitting sub-stage T22-3. Wherein in the modulating sub-stage T21-3, the third transistor M3 turned on can provide the signal input into the connection node NO to the in-phase input PA of the comparator AC, such that the voltage of the in-phase input PA of the comparator AC is $V_{03-3}$. Since the voltage of the anti-phase input PB of the comparator AC is increased to $V_{03-3}$ from $V_{01}$, the voltage of the in-phase input PA is larger than the voltage of the anti-phase input PB, such that an output of the comparator AC outputs a high-level signal. Since the comparator AC outputs the high-level signal which can turn off the first transistor M1, the light-emitting device DL stops emitting light in the modulating sub-stage T21-3.

In a light-emitting sub-stage T22-1, since the voltage of the anti-phase input PB of the comparator AC is increased from $V_{03-3}$ to $V_{02}$, the voltage of the in-phase input PA is smaller than the voltage of the anti-phase input PB, such that the output of the comparator AC outputs a low-level signal. Since the comparator AC outputs a low-level signal, the first transistor M1 can be turned on, such that the drive circuit I generated by the drive transistor M0 can be provided to the light-emitting device DL, to drive the light-emitting device DL to emit light in the light-emitting sub-stage T22-3.

It can be seen from the above that, the light-emitting duration of the light-emitting device DL can be controlled through adjusting the voltage of the duration control signal terminal SM, thereby displaying more gray scales through controlling the light-emitting duration, and improving the display effect.

It should be noted that, based on the above embodiments, the preset duration can be the duration of the light-emitting stage T20. Of course, during practical applications, the preset duration can be other time, which is not defined herein.

It can be understood that, in some embodiments, the voltage $V_{ref}$ of the reference voltage signal terminal VREF can also be changed oscillatingly within a preset duration. The voltage of the duration control signal terminal is a fixed voltage, and the voltage of the duration control signal terminal is within a voltage range which can be provided by the reference voltage signal terminal.

The structural schematic diagram of some other display devices provided in the embodiment of the present disclosure is as shown in FIG. 9, which is distorted aiming at the implementing manners in the above embodiments. Only the differences between the present embodiment and the above embodiments are described below, and the same parts are not repeated redundantly herein.

During specific implementation, in the embodiment of the present disclosure, in combination with FIG. 2, FIG. 6 and FIG. 9, the display device can further include a plurality of light-emitting control signal lines 150 independent with one another. The light-emitting control signal terminals EM of the drive circuits 112 of a row of sub-pixels are correspondingly electrically connected with the light-emitting control signal line 150. In this way, through inputting different signals to the respective light-emitting control signal lines 150, the third transistor M3 and the fifth transistor M5 can be turned on row by row. Of course, the third transistor M3 and the fifth transistor M5 can be turned on simultaneously through inputting the same signal to the respective light-emitting control signal lines 150.

Figure 10:
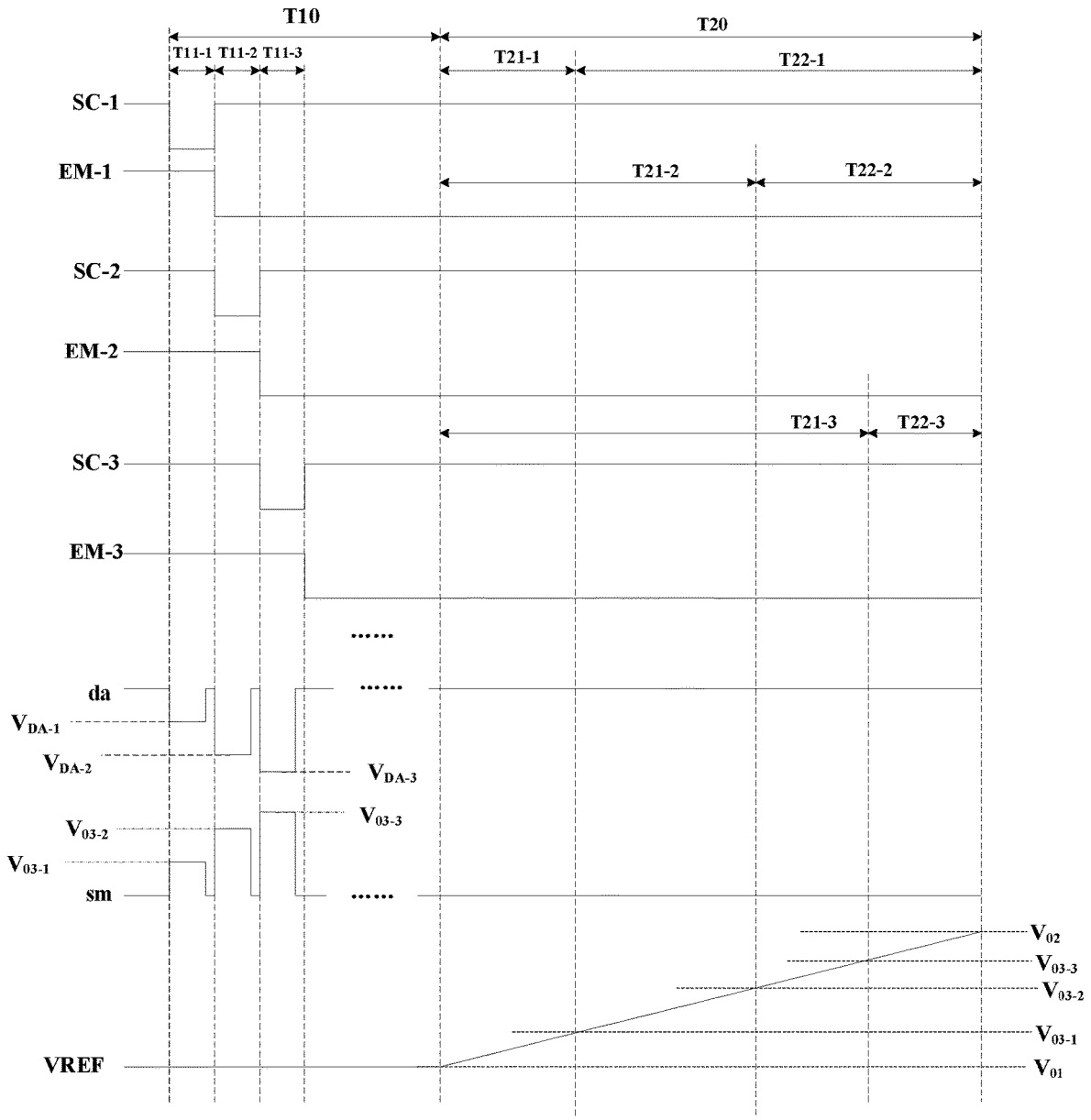
FIG. 10 is a sequence chart of still some other circuits of the display device provided in the embodiment of the present disclosure.

The working process of the display device provided in the embodiment of the present disclosure will be described below in combination with the sequence chart of a circuit shown in FIG. 10 and with the structure shown in FIG. 6 and FIG. 9 as an example. Wherein the signal input stage T10 and the light-emitting stage T20 in the sequence chart of the circuit shown in FIG. 9 are primarily selected. It should be noted that, the voltage of the reference voltage signal terminal VREF can be increased from the first voltage $V_{01}$ to the second voltage $V_{02}$ within a preset duration, and the voltage of the duration control signal terminal SM can be a fixed voltage $V_{03}$ which is larger than the first voltage $V_{01}$ and smaller than the second voltage $V_{02}$.

The working stage of the display device within a frame can include a signal input stage T10 and a light-emitting stage T20. The signal input stage T10 can include a plurality of signal input sub-stages T11-*n*, wherein n is greater than or equal to 1 and less than or equal to N, N and n are both integers, and N represents the total number of rows of sub-pixels in the display device. The light-emitting stage T20 can include: a modulating sub-stage T21 and a light-emitting sub-stage T22.

In the signal input stage T10, signals are loaded row by row to the scanning signal terminals of the drive circuits in the respective rows of sub-pixels, to drive the rows of sub-pixels row by row. Wherein, sub-pixels from the first row to the third row are taken as an example for illustration. SC-1 represents the signal received by the scanning signal terminal SC of the drive circuit of the first row of sub-pixels, and EM-1 represents the signal received by the light-emitting control signal terminal EM of the drive circuit of the first row of sub-pixels. SC-2 represents the signal received by the scanning signal terminal SC of the drive circuit of the second row of sub-pixels, and EM-2 represents the signal received by the light-emitting control signal terminal EM of the drive circuit of the second row of sub-pixels. SC-3 represents the signal received by the scanning signal terminal SC of the drive circuit of the third row of sub-pixels, and EM-3 represents the signal received by the light-emitting control signal terminal EM of the drive circuit of the third row of sub-pixels. Further, da represents the signal transmitted in the data line, and sm represents the signal transmitted in the duration control signal line.

Specifically, in the signal input sub-stage T11-1, the first row of sub-pixels are driven. Wherein, the scanning signal terminal SC of the drive circuit in the first row of sub-pixels has a low-level signal which can turn on the second transistor M2 and the fourth transistor M4 turned on. The light-emitting control signal terminal EM has a high-level signal which can turn off the third transistor M3 and the fifth transistor M5. The fourth transistor M4 turned on can provide the signal da transmitted to the data signal terminal DA through a data line to the gate of the drive transistor M0, and the signal da is stored in the second capacitor C2. Since the gate voltage of the drive transistor M0 is the voltage $V_{DA-1}$ of the signal of the data signal terminal DA and the source voltage of the drive transistor M0 is $V_{dd}$, the drive transistor M0 can generate a drive current I, and $I=K(V_{sg}-|V_{th}|)^2=K(V_{dd}-V_{DA-1}-|V_{th}|)_2$, wherein $V_{sg}$ is a source-to-gate voltage of the drive transistor M0, and K is a structural parameter. The numerical value of K is relatively stable in the same structure, and can serve as a constant. The second transistor M2 turned on can provide the signal sm transmitted to the duration control signal terminal SM through the duration control signal line to the connection node NO, such that the voltage of the signal of the connection node NO is $V_{03-1}$, and is stored in the first capacitor C1.

Afterwards, the scanning signal terminal SC of the drive circuit in the first row of sub-pixels has a high-level signal which can turn off the second transistor M2 and the fourth transistor M4. The light-emitting control signal terminal EM has a low-level signal which can turn on the third transistor M3 and the fifth transistor M5.

In a signal input sub-stage T11-2, the second row of sub-pixels are driven. Wherein, the scanning signal terminal SC of the drive circuit in the second row of sub-pixels has a low-level signal which can turn on the second transistor M2 and the fourth transistor M4. The light-emitting control signal terminal EM has a high-level signal which can turn off the third transistor M3 and the fifth transistor M5. The fourth transistor M4 turned on can provide the signal da transmitted to the data signal terminal DA through a data line to the gate of the drive transistor M0, and the signal da is stored in the second capacitor C2. Since the gate voltage of the drive transistor M0 is the voltage $V_{DA-2}$ of the signal of the data signal terminal DA and the source voltage of the drive transistor M0 is $V_{dd}$, the drive transistor M0 can generate a drive current I, and $I=K(V_{sg}-|V_{th}|)^2=K(V_{dd}-V_{DA-2}-|V_{th}|)^2$, wherein $V_{sg}$ is a source-to-gate voltage of the drive transistor M0, and K is a structural parameter. The numerical value of K is relatively stable in the same structure, and can serve as a constant. The second transistor M2 turned on can provide the signal sm transmitted to the duration control signal terminal SM through the duration control signal line to the connection node NO, such that the voltage of the signal of the connection node NO is $V_{03-2}$, and is stored in the first capacitor C1.

Afterwards, the scanning signal terminal SC of the drive circuit in the second row of sub-pixels has a high-level signal which can turn off the second transistor M2 and the fourth transistor M4. The light-emitting turn on signal terminal EM has a low-level signal which can control the third transistor M3 and the fifth transistor M5.

In a signal input sub-stage T11-3, the third row of sub-pixels are driven. Wherein, the scanning signal terminal SC of the drive circuit in the third row of sub-pixels has a low-level signal which can turn on the second transistor M2 and the fourth transistor M4. The light-emitting control signal terminal EM has a high-level signal which can turn off the third transistor M3 and the fifth transistor M5. The fourth transistor M4 turned on can provide the signal da transmitted to the data signal terminal DA through a data line to the gate of the drive transistor M0, and the signal da is stored in the second capacitor C2. Since the gate voltage of the drive transistor M0 is the voltage $V_{DA-3}$ of the signal of the data signal terminal DA and the source voltage of the drive transistor M0 is $V_{dd}$, the drive transistor M0 can generate a drive current I, and $I=K(V_{sg}-V_{th}|)^2=K(V_{dd}-V_{DA-3}-\bigstar V_{th}|)^2$, wherein $V_{sg}$ is a source-to-gate voltage of the drive transistor M0, and K is a structural parameter. The numerical value of K is relatively stable in the same structure, and can serve as a constant. The second transistor M2 turned on can provide the signal sm transmitted to the duration control signal terminal SM through the duration control signal line to the connection node NO, such that the voltage of the signal of the connection node NO is $V_{03-3}$, and is stored in the first capacitor C1.

Afterwards, the scanning signal terminal SC of the drive circuit in the third row of sub-pixels has a high-level signal which can turn off the second transistor M2 and the fourth transistor M4. The light-emitting control signal terminal EM has a low-level signal which can turn on the third transistor M3 and the fifth transistor M5.

Afterwards, the fourth row of sub-pixels to the last row of sub-pixels are driven in sequence, and the working processes can be analogized in sequence, which will not be repeated redundantly herein.

Then entering the light-emitting stage T20, wherein the scanning signal terminal SC of each drive circuit in the display device has a high-level signal which can turn off the second transistor M2 and the fourth transistor M4. The light-emitting control signal terminal EM in each drive circuit in the display device has a low-level signal which can turn on the third transistor M3 and the fifth transistor M5. The third transistor M3 turned on can provide the signal input to the connection node NO to the in-phase input PA of the comparator AC.

For the drive circuit in a sub-pixel in the first row of the display device, the light-emitting stage T20 can include a modulating sub-stage T21-1 and a light-emitting sub-stage T22-1. Wherein in the modulating sub-stage T21-1, the third transistor M3 turned on can provide the signal input into the connection node NO to the in-phase input PA of the comparator AC, such that the voltage of the in-phase input PA of the comparator AC is $V_{03-1}$. Since the voltage of the anti-phase input PB of the comparator AC is increased to $V_{03-1}$ from $V_{01}$, the voltage of the in-phase input PA is larger than the voltage of the anti-phase input PB, such that an output of the comparator AC outputs a high-level signal. Since the comparator AC outputs the high-level signal which can turn off the first transistor M1, the light-emitting device DL stops emitting light in the modulating sub-stage T21-1.

In a light-emitting sub-stage T22-1, since the voltage of the anti-phase input PB of the comparator AC is increased from $V_{03-1}$ to $V_{02}$, the voltage of the in-phase input PA is smaller than the voltage of the anti-phase input PB, such that the output of the comparator AC outputs a low-level signal. Since the comparator AC outputs a low-level signal, the first transistor M1 can be turned on, the drive circuit I generated by the drive transistor M0 can be provided to the light-emitting device DL, to drive the light-emitting device DL to emit light in the light-emitting sub-stage T22-1.

For the drive circuit in a sub-pixel in the second row of the display device, the light-emitting stage T20 can include a modulating sub-stage T21-2 and a light-emitting sub-stage T22-2. Wherein in the modulating sub-stage T21-2, the third transistor M3 turned on can provide the signal input into the connection node NO to the in-phase input PA of the comparator AC, such that the voltage of the in-phase input PA of the comparator AC is $V_{03-2}$. Since the voltage of the anti-phase input PB of the comparator AC is increased to $V_{03-2}$ from $V_{01}$, the voltage of the in-phase input PA is larger than the voltage of the anti-phase input PB, such that an output of the comparator AC outputs a high-level signal. Since the comparator AC outputs the high-level signal which can turn off the first transistor M1, the light-emitting device DL stops emitting light in the modulating sub-stage T21-2.

In a light-emitting sub-stage T22-1, since the voltage of the anti-phase input PB of the comparator AC is increased from $V_{03-2}$ to $V_{02}$, the voltage of the in-phase input PA is smaller than the voltage of the anti-phase input PB, such that the output of the comparator AC outputs a low-level signal. Since the comparator AC outputs a low-level signal, the first transistor M1 can be turned on, the drive circuit I generated by the drive transistor M0 can be provided to the light-emitting device DL, to drive the light-emitting device DL to emit light in the light-emitting sub-stage T22-2.

For the drive circuit in a sub-pixel in the third row of the display device, the light-emitting stage T20 can include a modulating sub-stage T21-3 and a light-emitting sub-stage T22-3. Wherein in the modulating sub-stage T21-3, the third transistor M3 turned on can provide the signal input into the connection node NO to the in-phase input PA of the comparator AC, such that the voltage of the in-phase input PA of the comparator AC is $V_{03-3}$. Since the voltage of the anti-phase input PB of the comparator AC is increased to $V_{03-3}$ from $V_{01}$, the voltage of the in-phase input PA is larger than the voltage of the anti-phase input PB, such that an output of the comparator AC outputs a high-level signal. Since the comparator AC outputs the high-level signal which can turn off the first transistor M1, the light-emitting device DL stops emitting light in the modulating sub-stage T21-3.

In a light-emitting sub-stage T22-1, since the voltage of the anti-phase input PB of the comparator AC is increased from $V_{03-3}$ to $V_{02}$, the voltage of the in-phase input PA is smaller than the voltage of the anti-phase input PB, such that the output of the comparator AC outputs a low-level signal. Since the comparator AC outputs a low-level signal, the first transistor M1 can be turned on, such that the drive circuit I generated by the drive transistor M0 can be provided to the light-emitting device DL, to drive the light-emitting device DL to emit light in the light-emitting sub-stage T22-3.

It can be seen from the above that, the light-emitting duration of the light-emitting device DL can be adjusted through setting the voltage of the duration control signal terminal SM, thereby displaying more gray scales through controlling the light-emitting duration, and improving the display effect.

During specific implementation, in the embodiments of the present disclosure, the display device can be a mobile phone, a tablet personal computer, a television, a display, a notebook computer, a digital photo frame, a navigator and any other products or parts with a display function. The other essential components of the display device should be provided as understood by those skilled in the art, are not repeated redundantly herein, and also should not be deemed as a limitation to the present disclosure.

As to the drive circuit, the driving method thereof and the display device provided in embodiments of the present disclosure, a drive current which drives the device to be driven to operate can be generated by the current control circuit; a light-emitting duration modulating signal input into the gate of the first transistor can be generated by the duration control circuit, to control the conduction duration of the first transistor, and further to control the duration during which the device to be driven receives the drive current. Moreover, in this way, the drive current flowing to the device to be driven and the conduction duration of the first transistor can be separately controlled, such that the conduction duration of the first transistor can be independently controlled, and further the adjustment range of the duration of the drive current flowing to the device to be driven can be larger.

Evidently those skilled in the art can make various modifications and variations to the embodiment of the present disclosure without departing from the spirit and scope of the embodiment of the present disclosure. Thus the present disclosure is also intended to encompass these modifications and variations thereto so long as the modifications and variations come into the scope of the claims appended to the present disclosure and their equivalents.

What is claimed is:

1. A drive circuit, comprising:

a current control circuit, configured to provide a drive signal to a device to be driven according to a signal of a data signal terminal;

a first transistor, electrically connected between the current control circuit and the device to be driven; and a duration control circuit, electrically connected with a gate of the first transistor, and configured to provide a light-emitting duration modulating signal to the gate of the first transistor according to a combined action of a signal of a scanning signal terminal, a signal of a light-emitting control signal terminal, a signal of a duration control signal terminal and a signal of a reference voltage signal terminal, to control a conduction duration of the first transistor.

2. The drive circuit of claim 1, wherein the duration control circuit comprises an input control sub-circuit and a comparison sub-circuit;

the input control sub-circuit is configured to provide the signal of the duration control signal terminal to a connection node in response to the signal of the scanning signal terminal, and provide a signal of the connection node to the comparison sub-circuit in response to the signal of the light-emitting control signal terminal; and the comparison sub-circuit is configured to output the light-emitting duration modulating signal according to a signal output by the input control sub-circuit and the signal of the reference voltage signal terminal.

3. The drive circuit of claim 2, wherein the input control sub-circuit comprises a second transistor, a third transistor and a first capacitor;

a gate of the second transistor is electrically connected with the scanning signal terminal, a first end of the second transistor is electrically connected with the duration control signal terminal, and a second end of the second transistor is electrically connected with the connection node;

a gate of the third transistor is electrically connected with the light-emitting control signal terminal, a first end of the third transistor is electrically connected with the connection node, and a second end of the third transistor is electrically connected with the comparison sub-circuit; and the first capacitor is electrically connected between a first power terminal and the connection node.

4. The drive circuit of claim 3, wherein the current control circuit comprises a drive transistor, a fourth transistor and a second capacitor;

a gate of the fourth transistor is electrically connected with the scanning signal terminal, a first end of the fourth transistor is electrically connected with the data signal terminal, and a second end of the fourth transistor is electrically connected with a gate of the drive transistor;

a first end of the drive transistor is electrically connected with the first power terminal, and a second end of the drive transistor is electrically connected with the first end of the first transistor; and the second capacitor is electrically connected between the gate of the drive transistor and the first power terminal.

5. The drive circuit of claim 3, further comprising: a fifth transistor, wherein the first transistor is electrically connected with the device to be driven through the fifth transistor; and the gate of the fifth transistor is electrically connected with the light-emitting control signal terminal.

6. The drive circuit of claim 2, wherein the comparison sub-circuit comprises a comparator;

an in-phase input of the comparator is electrically connected with the input control sub-circuit, an anti-phase input of the comparator is electrically connected with the reference voltage signal terminal, and an output of the comparator is electrically connected with the gate of the first transistor.

7. The drive circuit of claim 6, wherein the current control circuit comprises a drive transistor, a fourth transistor and a second capacitor;

a gate of the fourth transistor is electrically connected with the scanning signal terminal, a first end of the fourth transistor is electrically connected with the data signal terminal, and a second end of the fourth transistor is electrically connected with a gate of the drive transistor;

a first end of the drive transistor is electrically connected with the first power terminal, and a second end of the drive transistor is electrically connected with the first end of the first transistor; and the second capacitor is electrically connected between the gate of the drive transistor and the first power terminal.

8. The drive circuit of claim 6, further comprising: a fifth transistor, wherein the first transistor is electrically connected with the device to be driven through the fifth transistor; and the gate of the fifth transistor is electrically connected with the light-emitting control signal terminal.

9. The drive circuit of claim 2, wherein the current control circuit comprises a drive transistor, a fourth transistor and a second capacitor;

a gate of the fourth transistor is electrically connected with the scanning signal terminal, a first end of the fourth transistor is electrically connected with the data signal terminal, and a second end of the fourth transistor is electrically connected with a gate of the drive transistor;

a first end of the drive transistor is electrically connected with the first power terminal, and a second end of the drive transistor is electrically connected with the first end of the first transistor; and the second capacitor is electrically connected between the gate of the drive transistor and the first power terminal.

10. The drive circuit of claim 2, further comprising: a fifth transistor, wherein the first transistor is electrically connected with the device to be driven through the fifth transistor; and the gate of the fifth transistor is electrically connected with the light-emitting control signal terminal.

11. The drive circuit of claim 1, wherein the current control circuit comprises a drive transistor, a fourth transistor and a second capacitor;

a gate of the fourth transistor is electrically connected with the scanning signal terminal, a first end of the fourth transistor is electrically connected with the data signal terminal, and a second end of the fourth transistor is electrically connected with a gate of the drive transistor;

a first end of the drive transistor is electrically connected with the first power terminal, and a second end of the drive transistor is electrically connected with the first end of the first transistor; and the second capacitor is electrically connected between the gate of the drive transistor and the first power terminal.

12. The drive circuit of claim 11, further comprising: a fifth transistor, wherein the first transistor is electrically connected with the device to be driven through the fifth transistor; and the gate of the fifth transistor is electrically connected with the light-emitting control signal terminal.

13. The drive circuit of claim 1, further comprising: a fifth transistor, wherein the first transistor is electrically connected with the device to be driven through the fifth transistor; and the gate of the fifth transistor is electrically connected with the light-emitting control signal terminal.

14. A display device, comprising:

a substrate; and a plurality of sub-pixels, on one side of the substrate; wherein at least one of the plurality of sub-pixels comprises a light-emitting device, and the drive circuit of claim 1; wherein the light-emitting device serves as the device to be driven.

15. The display device of claim 14, wherein the display device further comprises a plurality of light-emitting control signal lines and a light-emitting control input; wherein light-emitting control signal terminals of the drive circuits of a row of sub-pixels are correspondingly electrically connected with a light-emitting control signal line; and each of the light-emitting control signal lines is electrically connected with the light-emitting control input.

16. The display device of claim 15, wherein the device to be driven comprises: at least one of a micro light emitting diode, an organic electroluminescent diode or a quantum dot light emitting diode.

17. The display device of claim 14, wherein the display device further comprises a plurality of light-emitting control signal lines independent with one another; and light-emitting control signal terminals of the drive circuits of a row of sub-pixels are correspondingly electrically connected with a light-emitting control signal line.

18. The display device of claim 17, wherein the device to be driven comprises: at least one of a micro light emitting diode, an organic electroluminescent diode or a quantum dot light emitting diode.

19. The display device of claim 14, wherein the device to be driven comprises: at least one of a micro light emitting diode, an organic electroluminescent diode or a quantum dot light emitting diode.

20. A driving method of the display device of claim 14, comprising:

for each row of sub-pixels, inputting, by the current control circuit, the signal of the data signal terminal in response to the signal of the scanning signal terminal in a signal input stage;

inputting, by the duration control circuit, the signal of the duration control signal terminal in response to the signal of the scanning signal terminal in the signal input stage;

generating, by the current control circuit, the drive signal which drives the device to be driven to emit light according to the signal of the data signal terminal; and providing, by the duration control circuit, the light-emitting duration modulating signal to the gate of the first transistor according to the combined action of the signal of the light-emitting control signal terminal, the signal of the reference voltage signal terminal and the signal of the duration control signal terminal, to control the conduction duration of the first transistor; wherein a voltage of the reference voltage signal terminal is changed monotonously in a preset duration, a voltage of the duration control signal terminal is a fixed voltage and the fixed voltage is within the monotonously changed range of the voltage of the reference voltage signal terminal, and one frame comprises the signal input stage and the light-emitting stage.

* * * * *